US005816845A

United States Patent [19]

Chishima et al.

[11] Patent Number: 5,816,845

[45] Date of Patent: Oct. 6, 1998

[54] CONNECTOR FOR FLAT CABLE

[75] Inventors: Masamitsu Chishima; Yutaka Noro, both of Yokkaichi, Japan

[73] Assignee: Sumitomo Wiring Systems, Ltd., Yokkaichi, Japan

[21] Appl. No.: 523,547

[22] Filed: Sep. 5, 1995

[30] Foreign Application Priority Data

Sep. 12, 1994 [JP] Japan ..... 6-244693
Sep. 12, 1994 [JP] Japan ..... 6-244694

[51] Int. Cl.[6] ..... H01R 9/07

[52] U.S. Cl. ..... 439/495

[58] Field of Search ..... 439/492–496, 439/260, 680, 67, 404, 405

[56] References Cited

U.S. PATENT DOCUMENTS

| | | | |
|---|---|---|---|
| 4,581,495 | 4/1986 | Geri et al. | 439/493 |
| 4,629,271 | 12/1986 | Awano | 439/493 |
| 4,808,113 | 2/1989 | Kanesige et al. | 439/493 |
| 4,900,268 | 2/1990 | Kunishi | 439/493 |
| 4,969,840 | 11/1990 | Ii et al. | 439/495 |
| 5,106,311 | 4/1992 | Yodogawa | 439/492 |
| 5,194,017 | 3/1993 | Consoli | 439/495 |
| 5,277,621 | 1/1994 | Seto | 439/493 |
| 5,354,214 | 10/1994 | Aso et al. | 439/492 |
| 5,370,552 | 12/1994 | Chishima et al. | 439/495 |
| 5,397,247 | 3/1995 | Aoki et al. | 439/495 |
| 5,474,468 | 12/1995 | Chishima et al. | 439/495 |
| 5,498,169 | 3/1996 | Ikemoto | 439/495 |
| 5,514,008 | 5/1996 | Kocher et al. | 439/67 |

FOREIGN PATENT DOCUMENTS 2-86080 3/1990 Japan .

*Primary Examiner*—Neil Abrams
*Assistant Examiner*—Brian J. Biggi
*Attorney, Agent, or Firm*—Oliff & Berridge, PLC

[57] ABSTRACT

When a slide member of a connector is moved toward a provisionally-retained position, each slanting guided surface is moved into sliding contact with an associated slanting guide surface, and is guided by the guide surface, so that the posture of the slide member is inclined upwardly outwardly. During this movement, the slide member is not interrupted, and therefore an operator's fingers will not be disengaged from the slide member. Therefore, the slide member can be withdrawn in a single continuous motion. Additionally, another feature of the connector prevents a flat cable from being erroneously inserted into a slide member insertion space in a provisionally-retained condition. In the provisionally-retained condition, erroneous insertion prevention piece portions project into an open portion of the slide member insertion space, and therefore, the flat cable advancing toward the open portion abuts against guide surfaces of the erroneous insertion prevention piece portions, and is guided by the guide surfaces toward a lower open portion into a flat cable insertion space. Therefore, the flat cable will not be erroneously inserted into the slide member insertion space.

16 Claims, 17 Drawing Sheets

CONNECTOR FOR FLAT CABLE

BACKGROUND OF THE INVENTION

1. Field of the Invention

This invention relates to a connector used for connecting a flat cable to a printed circuit board.

2. Description of Related Art

One conventional connector used for connecting a flat cable to a printed circuit board is disclosed in Japanese Unexamined Patent Publication No. 2-86080. As shown in FIGS. 1A and 1B, the connector comprises a housing 101 having juxtaposed metal terminals 100 projecting into a cavity 102 and a slide member 103 displaceable relative to the housing 101 between a completely-retained position and a provisionally-retained position. The housing 101 of the connector is beforehand fixed to a printed circuit board 104, and the metal terminals 100 are passed through respective holes 105 in the printed circuit board 104 and connected to respective circuit contacts (not shown). Then, the slide member 103 is held in a provisionally-retained condition to keep an insertion port 106 of the cavity 102 open as shown in FIG. 1A, and, in this condition, a flat cable 107 is inserted into the cavity 102. Then, as shown in FIG. 1B, the slide member 103 is displaced into the completely-retained position to be inserted into the cavity 102 so that the slide member 103 presses the flat cable 107 against the metal terminals 100. As a result, the metal terminals 100 contact respective terminal contacts of the flat cable 107. Thus, the flat cable 107 is connected to the printed circuit board 104 through the metal terminals 100.

This conventional connector is of such a small size that it can be barely held by an operator's fingers, and therefore the opening defined by the insertion port 106 is very narrow. Therefore, when the flat cable 107 is to be inserted, the slide member 103 is drawn into an outwardly-inclined posture in its provisionally-retained position, so that the insertion port 106 is fully opened so as to facilitate the insertion of the flat cable 107.

In order to bring the slide member 103 into the inclined posture, the housing 101 has holding portions 110 inclined relative to the direction of movement of the slide member 103, and the slide member 103 has a retaining portion 111 disposed perpendicular to the direction of movement thereof, as shown in FIGS. 2A to 2C. The slide member 103 is drawn or moved from the completely-retained position (FIG. 2A) and, immediately before the slide member 103 reaches the provisionally-retained position, the retaining portion 111 is brought into contact with an end of the holding portion 110 in a point-contact manner as shown in FIG. 2B. Then, when a withdrawing force is further applied to the slide member 103, the slide member 103 is turned into an inclined posture, with the retaining portion 111 held in contact with the holding portion 110. Finally, in the provisionally-retained condition, the retaining portion 111 contacts the holding portions 110 over the entire contact surfaces thereof, thereby holding the slide member 103 in the inclined posture corresponding to the inclination of the holding portions 110.

Thus, for bringing the slide member 103 into the inclined posture, the retaining portion 111 first comes into contact with the holding portion 110 during withdrawing of the slide member 103, thus preventing further linear movement of the slide member 103 in the withdrawing direction. Thereafter, the slide member 103 is rotated by a clamming action into the inclined posture.

Therefore, the direction of drawing of the slide member 103 is changed from linear to rotative movement during the drawing operation, thus creating a cumbersome operation.

Moreover, during withdrawing of the slide member 103, the retaining portion 111 contacts the holding portions 110 and is prevented from moving in the withdrawing direction. Therefore, it is possible that the fingers holding the slide member 103 will become disengaged from the slide member 103. In this respect, the efficiency of the operation is inferior.

Furthermore, when the sliding member 103 is prevented from movement in the withdrawing direction upon contact of the retaining portion 111 with the holding portion 110, it may feel as though the slide member is caught or stuck, which is undesirable.

FIGS. 3 and 4 show another connector for connecting a flat cable. This connector comprises a housing 201 having juxtaposed metal terminals 200 projected into a cavity 202 and a slide member 203 displaceable relative to the housing 201 between a completely-retained position and a provisionally-retained position. The interior of the cavity 202 is divided by the metal terminals 200 into upper and lower spaces, that is, a slide member insertion space 202A and a flat cable insertion space 202B. The insertion of the slide member 203 into the slide member insertion space 202A and the insertion of a flat cable 204 into the flat cable insertion space 202B are effected through a common insertion port 205.

When the flat cable 204 is to be connected, the slide member 203 is displaced or drawn from the slide member insertion space 202A into the provisionally-retained position (FIG. 3) and held in a stand-by position outwardly of the insertion port 205. In this condition, the flat cable 204 is inserted into the flat cable insertion space 202B through the insertion port 205, as shown in solid lines in FIG. 3.

Thereafter, the slide member 203 is inserted into the slide member insertion space 202A, and is displaced into the completely-retained position, so that the slide member 203 urges the metal terminals 200 downwardly into contact with the upper surface of the flat cable 204 (see FIG. 4), thereby connecting the metal terminals 200 to respective terminal points (not shown) of the flat cable 204.

In this conventional connector, for facilitating the insertion of the flat cable 204, the slide member 203 in its provisionally-retained condition is kept inclined outwardly (upwardly) outside of the insertion port 205 of the cavity 202 so that open portion of the insertion port 205 communicating with the flat cable insertion space 202B is fully opened to the exterior of the housing 201.

However, the connector is of such a small size that it can be barely held by the fingers, and the area of opening of the insertion port 205 is small. Therefore, even though the slide member 203 is kept in the provisionally-retained condition to thereby fully open the open portion to communicate with the flat cable insertion space 202B, it is difficult to smoothly insert the flat cable 204 into the flat cable insertion space 202B with the hands of the operator.

In addition, in the insertion port 205, not only the open portion, which communicates with the flat cable insertion space 202B, but also an open portion communicating with the slide member insertion space 202A is fully opened. Moreover, the thus opened open portion communicating with the slide member insertion space 202A is continuous with the open portion communicating with the flat cable insertion space 202B.

Therefore, if the flat cable 204, when being inserted into the insertion port 205, is not properly directed toward the flat cable insertion space 202B, the flat cable 204 can be erroneously inserted into the slide member insertion space 202A as shown in broken lines in FIG. 4. Particularly when the insertion of the flat cable 204 is to be effected in a condition in which the insertion port 205 is concealed from the view of the operator by the slide member 203, such erroneous insertion is likely to occur.

It is possible that such erroneous insertion occurs when the open portion communicating with the slide member insertion space 202A is opened to the exterior of the housing 201, although the slide member 203, in its provisionally-retained position, is not inclined relative to the insertion port 205. Also, it is possible that such erroneous insertion occurs if the open portion communicating with the slide member insertion space 202A is opened to the exterior to the housing 201 in the provisionally-retained condition, although the open portion communicating with the slide member insertion space 202A is not continuous with the open portion communicating with the flat cable insertion space 202B.

SUMMARY OF THE INVENTION

With the above problems in view, it is an object of the invention to provide a connector in which a slide member can be drawn into an inclined posture in a provisionally-retained condition with an enhanced operation efficiency and an enhanced feeling of operation.

Another object of the invention is to provide a connector in which, when an open portion communicating with a slide member insertion space is opened to the exterior of a housing in a provisionally-retained condition, a flat cable is prevented from being erroneously inserted into the slide member insertion space.

According to one aspect of the present invention, there is provided a connector for a flat cable comprising a housing having a cavity into which the flat cable is adapted to be inserted through an insertion port in the housing; metal terminals mounted on the housing and inserted into the cavity; and a slide member displaceable relative to the housing between a completely-retained position and a provisionally-retained position. When the flat cable is to be inserted into the cavity, the slide member is displaced into the provisionally-retained position to be held in a stand-by position outwardly of the insertion port, the slide member is displaced into the completely-retained position to be inserted into the cavity to thereby hold the metal terminals in contact with the flat cable, a slanting guide surface inclined relative to a direction of insertion of the flat cable is formed on the housing, a slanting guided surface for sliding contact with the slanting guide surface during the movement of the slide member toward the provisionally-retained position is formed on the slide member, and the slanting guided surface is brought into sliding contact with the slanting guide surface during the movement of the slide member toward the provisionally-retained position, thereby guiding the slide member into a posture inclined outwardly relative to the insertion port.

In the above construction, a slanting guidance surface may be formed on the housing, and the slanting guidance surface guides the slide member in a direction of extension of the slanting guide surface over a path of displacement of the slide member from a position where the slanting guided surface is brought into sliding contact with the slanting guide surface to the provisionally-retained position.

In the present invention, when the slide member is drawn toward the provisionally-retained position, the slanting guided surface is brought into contact with the slanting guide surface, and the slide member is guided by this contact, and is changed in posture, so that the slide member takes the posture inclined outwardly relative to the insertion port of the cavity. As a result, the slide member is retracted from the insertion port, thereby fully opening the insertion port.

Because the posture of the slide member is changed in accordance with the inclination of the slanting guide surface and the slanting guided surface, the posture of the slide member can be changed smoothly, and this advantageously provides an excellent operation efficiency and an excellent operation feeling.

In the present invention, when the slide member, inclined as a result of the sliding contact between the slanting guide surface and the slanting guided surface, is further moved toward the provisionally-retained position, the slide member is guided in the direction of extension of the slanting guide surface. Therefore, the amount of retracting of the slide member from the insertion port is larger as compared with the case where the posture of the slide member is changed merely by the sliding contact between the slanting guide surface and the slanting guided surface. As a result, the extent of opening of the insertion port is increased.

Because the insertion port can be thus opened to a larger extent, the efficiency of insertion of the flat cable is better. Moreover, the slide member extends in the direction of extension of the slanting guide surface. Therefore, during the drawing of the slide member, the drawing direction is not changed, and also the slide member is not caught.

According to another aspect of the present invention, there is provided a connector for a flat cable comprising a housing having a cavity open to the exterior through an insertion port; a slide member displaceable relative to the housing between a completely-retained position and a provisionally-retained position; and metal terminals mounted on the housing and inserted into the cavity to divide the cavity into a flat cable insertion space and a slide member insertion space. When a flat cable is to be inserted into the flat cable insertion space, the slide member is displaced to the provisionally-retained position to be disposed in a stand-by position outwardly of the insertion port, the slide member is displaced into the completely-retained position to be inserted into the slide member insertion space so that the slide member presses the metal terminals into contact with the flat cable. Erroneous insertion prevention piece portions are formed on the slide member, and the erroneous insertion prevention piece portions project into an open portion of the insertion port, communicating with the slide member insertion space, in the provisionally-retained position, so that the erroneous insertion prevention piece portions can contact the flat cable to thereby prevent an erroneous insertion of the flat cable.

In the above construction, each of the erroneous insertion prevention piece portions may have a guide surface for guiding the flat cable toward the flat cable insertion space in a direction away from the slide member insertion space.

In the present invention, when the slide member is held in the provisionally-retained condition, the erroneous insertion prevention piece portions project into the open portion of the insertion port of the slide member insertion space. In this condition, when the flat cable is to be erroneously inserted into the slide member insertion space, the flat cable abuts against the erroneous insertion prevention piece portions and therefore prevented from insertion.

The erroneous insertion prevention piece portions prevent the flat cable from being erroneously inserted into the slide member insertion space, and therefore, the flat cable can be properly inserted into the flat cable insertion space.

In the present invention, when the flat cable begins to be erroneously inserted into the slide member insertion space, and hence abuts against the erroneous insertion prevention piece portions, the flat cable is guided toward the flat cable insertion space by the guide surfaces.

Since the flat cable can be guided toward the flat cable insertion space by the guide surfaces, the insertion of the flat cable can be effected easily and surely.

These and other advantages will be described in or apparent from the following description of preferred embodiments.

BRIEF DESCRIPTION OF THE DRAWINGS

Preferred embodiments of the invention will be described in detail with reference to the attached drawings, in which.

DETAILED DESCRIPTION OF PREFERRED EMBODIMENTS

1st Embodiment

A preferred embodiment of the present invention will now be described with reference to FIGS. 5 to 18.

A connector of this embodiment for a flat cable comprises a housing 10 of a non-electrically-conductive synthetic resin material, a slide member 30 of a non-electrically-conductive synthetic resin material, a plurality of metal terminals 40 of electrically-conductive metal and a holder 50 of electrically-conductive metal.

Figure 1A:
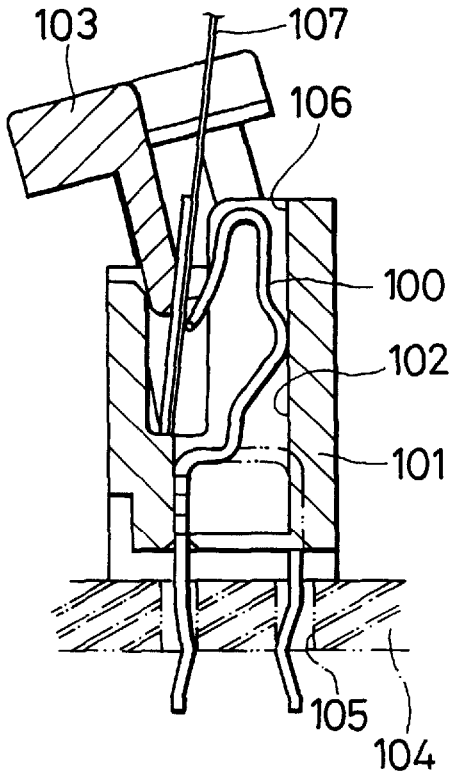
FIG. 1A PRIOR ART
FIGS. 1A and 1B are side-elevational views of a conventional connector showing the sequential process of a slide member.
Figure 1B:
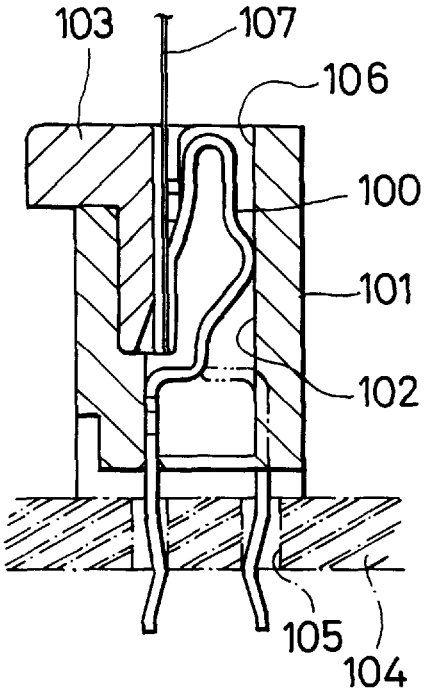
FIG. 1B PRIOR ART
Figure 2A:
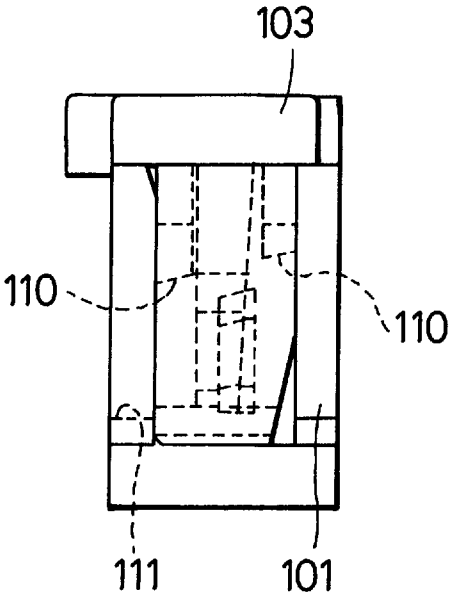
FIG. 2A PRIOR ART
FIGS. 2A to 2C are cross-sectional views of a conventional connector showing the interior of a cavity, in sequence.
Figure 2B:
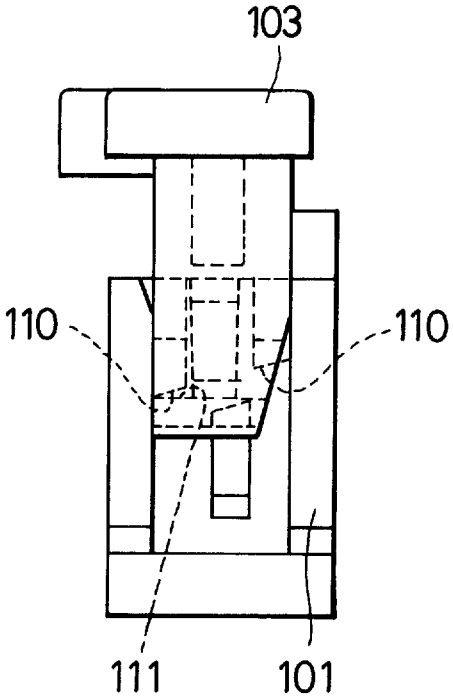
FIG. 2B PRIOR ART
Figure 2C:
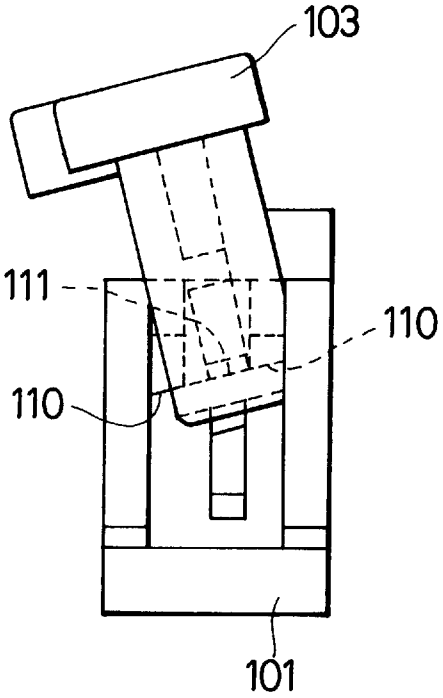
FIG. 2C PRIOR ART
Figure 3:
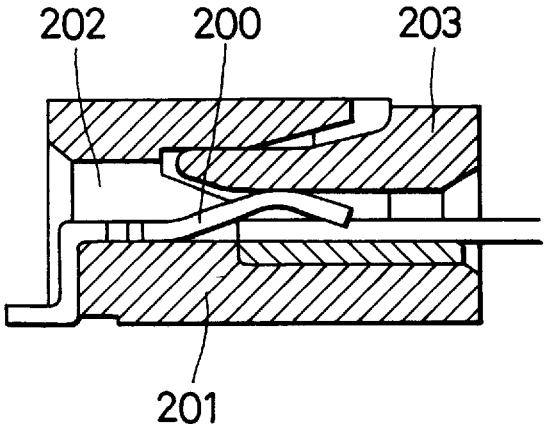
FIG. 3 PRIOR ART
FIG. 3 is a cross-sectional view of a conventional connector showing the interior of a cavity in a completely-retained condition.
Figure 4:
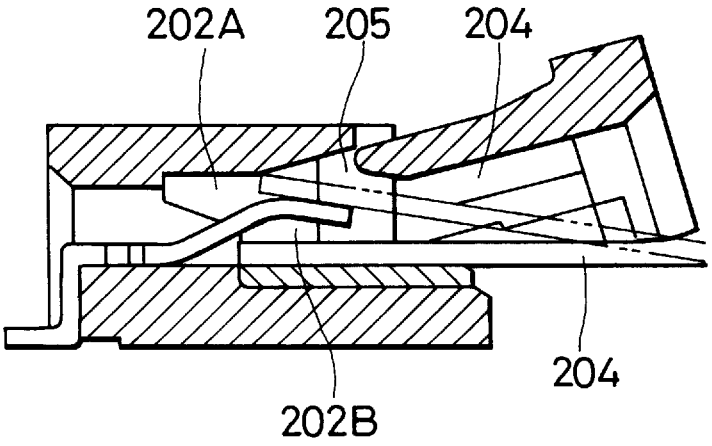
FIG. 4 PRIOR ART
FIG. 4 is a cross-sectional view of the above conventional connector showing the interior of the cavity in a provisionally-retained condition.
Figure 5:
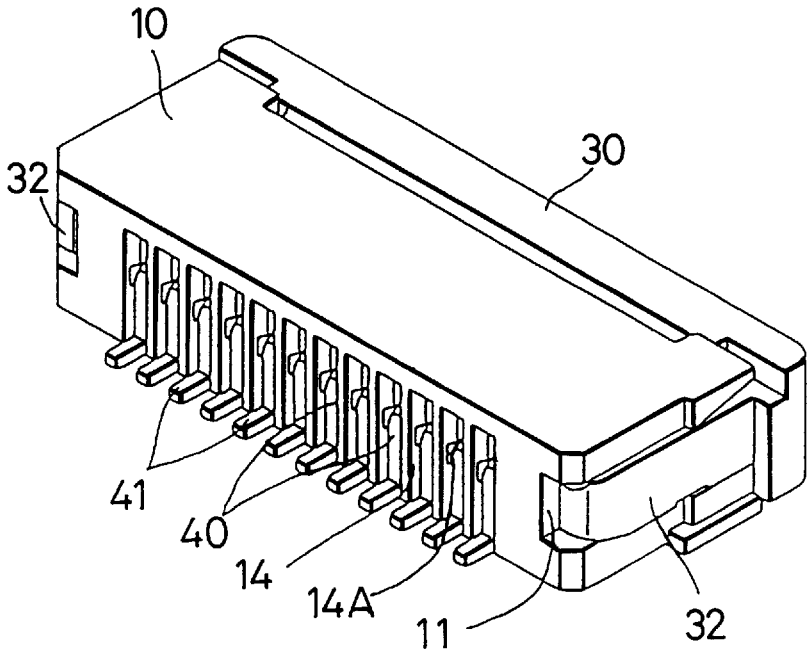
FIG. 5 is a perspective view of a preferred embodiment of a connector of the present invention in a completely-retained condition.
Figure 6:
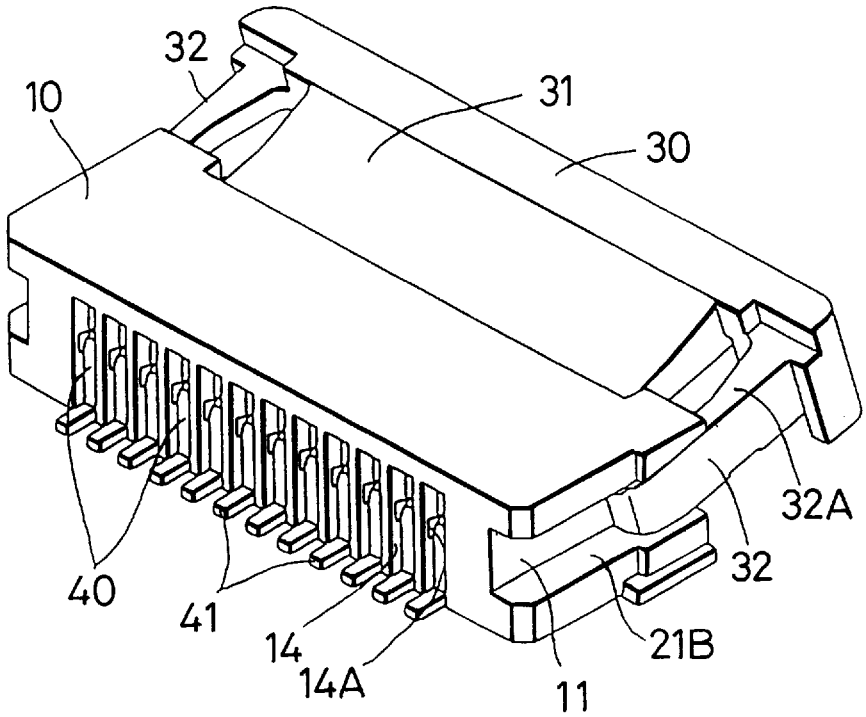
FIG. 6 is a perspective view of the connector in a provisionally-retained condition.
Figure 7:
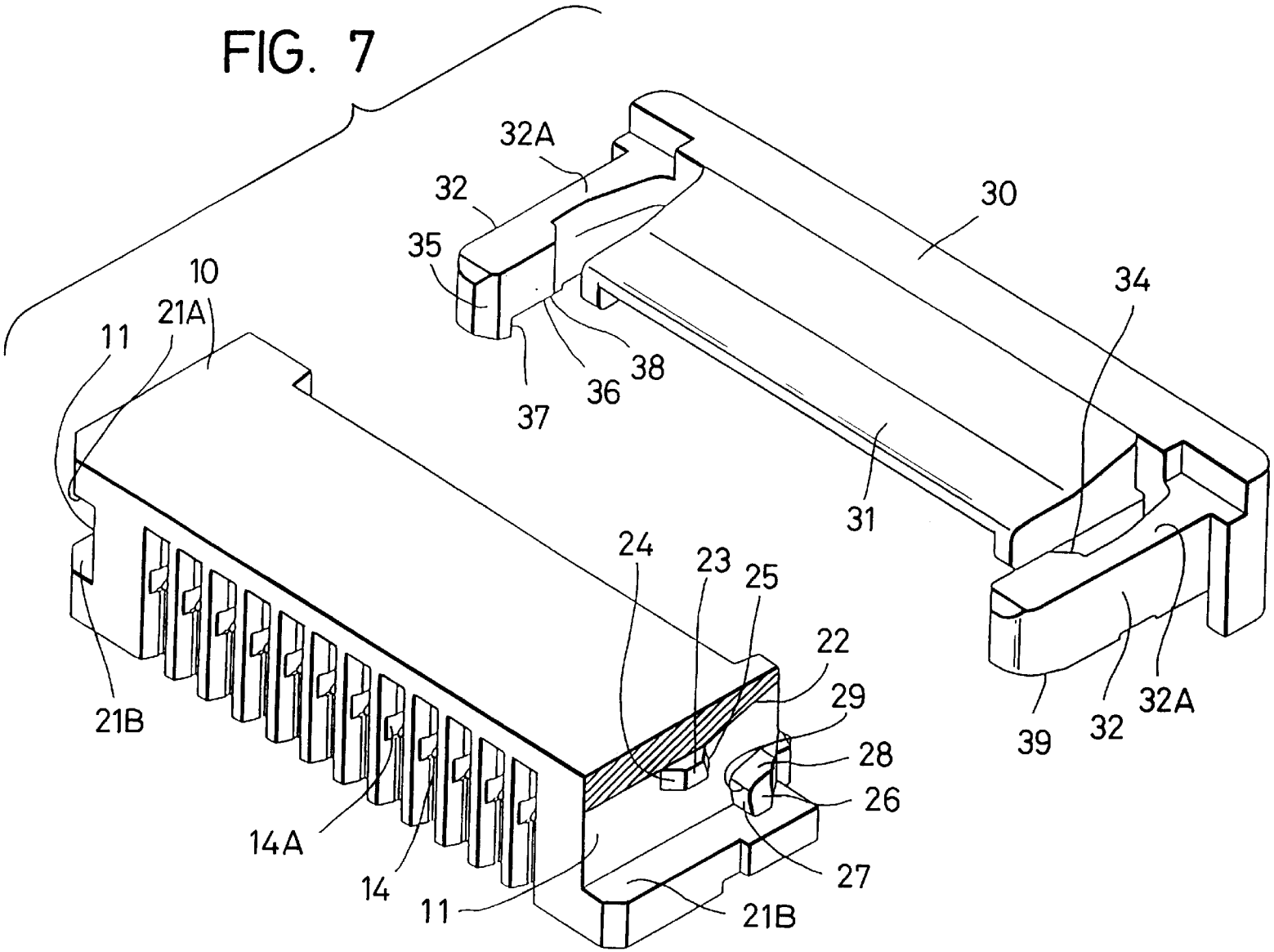
FIG. 7 is a partly-broken, perspective view showing a housing and a slide member separated from each other.
Figure 8:
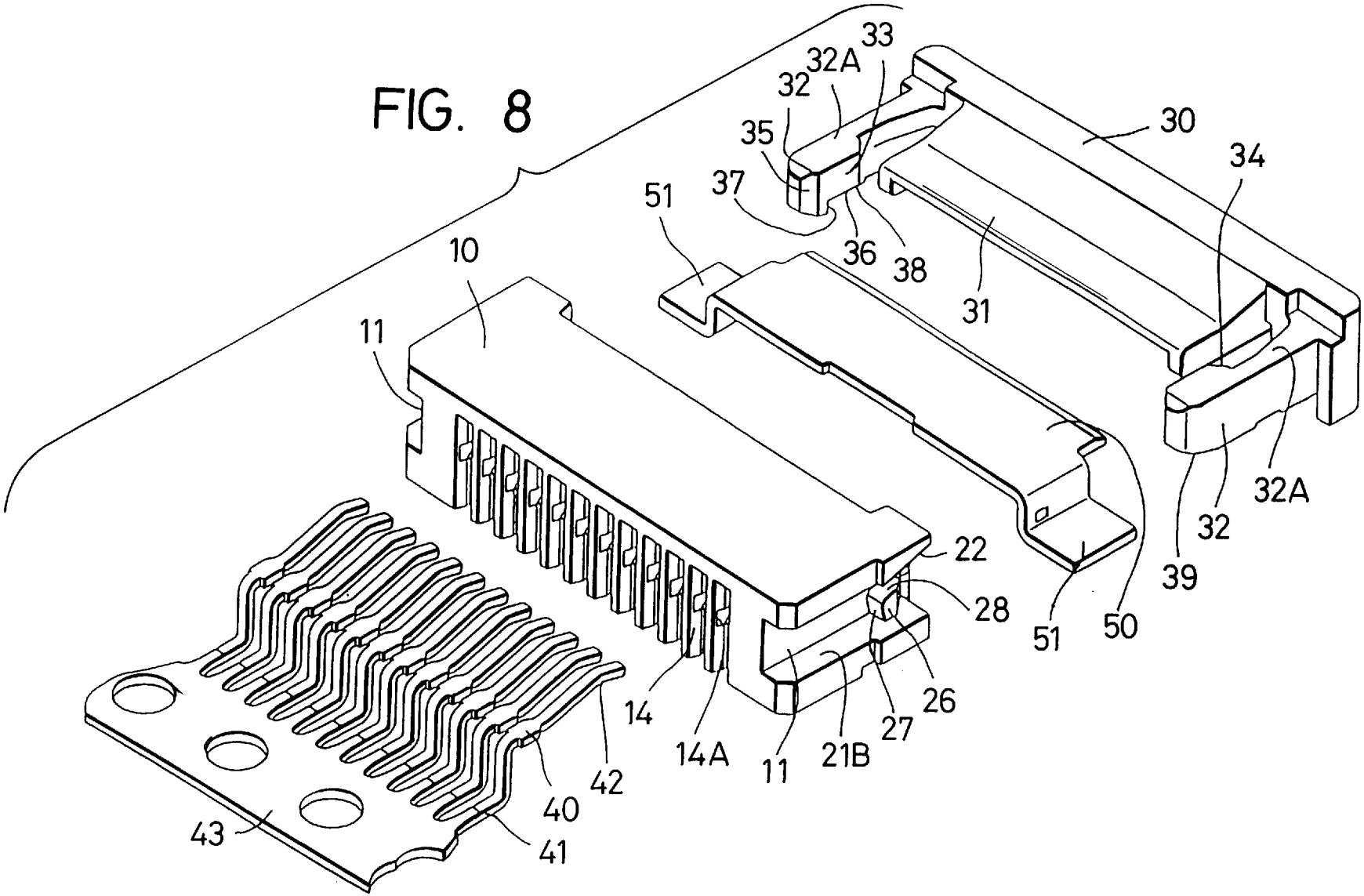
FIG. 8 is a perspective view showing the housing, the slide member, metal terminals and a holder separated from one another.

The housing 10 has a rectangular parallelepipedic shape as a whole, having a relatively small thickness between upper and lower surfaces thereof, and a relatively large width between right and left sides thereof. A pair of guide grooves 11 for guiding the movement of the slide member 30 between a completely-retained position and a provisionally-retained position are formed in the opposite (right and left) side surfaces of the housing 10, respectively. A cavity 12 is formed in the housing 10, and is open, as an insertion port 13, to a front surface of the housing 10. A plurality of holding holes 14 communicating with the cavity 12 are formed in a rear surface of the housing 10, and are juxtaposed in a right-to-left direction, the holding holes 14 being separated from one another at a distance corresponding to the spacing of the metal terminals 40, respectively. Each metal terminal 40 extending through the associated holding hole 14 is retained against withdrawal by a retaining groove 14A in the holding hole 14. Each metal terminal 40 has a crank-shaped contact portion 41 exposed to the exterior of the housing 10 and is connected to a corresponding circuit terminal of a printed circuit board (not shown), and a convexly-curved contact portion 42 projecting into the cavity 12 is connected to a corresponding terminal contact (not shown) on a flat cable 60. In FIG. 8, although the plurality of metal terminals 40 are interconnected by a carrier 43, the carrier 43 is separated from the metal terminals 40 after the metal terminals 40 are attached to the housing 10, so that the metal terminals 40 are (electrically) separated from one another.

The holder 50 is fixedly secured to a bottom surface of the cavity 12 by fixing means (not shown). Legs 51, formed respectively at the opposite (right and left) ends of the holder 50, pass through respective grooves 1 extending through a lower portion of the housing 10 from the cavity 12 to the bottom surface of the housing 10 and are exposed to the lower surface of the housing 10. The legs 51 are adapted to be soldered to the printed circuit board, thereby fastening the housing 10, together with the holder 50, to the printed circuit board.

Within the cavity 12, a flat cable insertion space 12B is formed (into which the flat cable 60 can be inserted) between the front end portions of the metal terminals 40 and the holder 50 underlying the front end portions. Also, a slide member insertion space 12A, into which a press plate portion 31 (described later) of the slide member 30 is inserted, is formed between the metal terminals 40 and a top surface of the cavity 12 overlying the terminals.

The top surface of the cavity 12 slants upwardly toward the insertion port 13 over a given distance to form a press plate portion-guiding slanting surface 15. The press plate portion-guiding slanting surface 15 cooperates with arm-guiding slanting surfaces 22 (described later) and slanting guide surfaces 28 (described later) to guide and hold the slide member 30 in a predetermined inclined posture in the provisionally-retained position.

The slide member 30 includes the press plate portion 31 adapted to be inserted into the slide member insertion space 12A of the cavity 12 and a pair of arms 32 spaced a predetermined distance from each other, and formed respectively at opposite (right and left) sides of the press plate portion 31, the pair of arms 32 being engaged respectively in the guide grooves 11 in the housing 10. The slide member 30 is held relative to the housing 10 at the provisionally-retained position and the completely-retained position, and is movable between the two retained positions.

Figure 11:
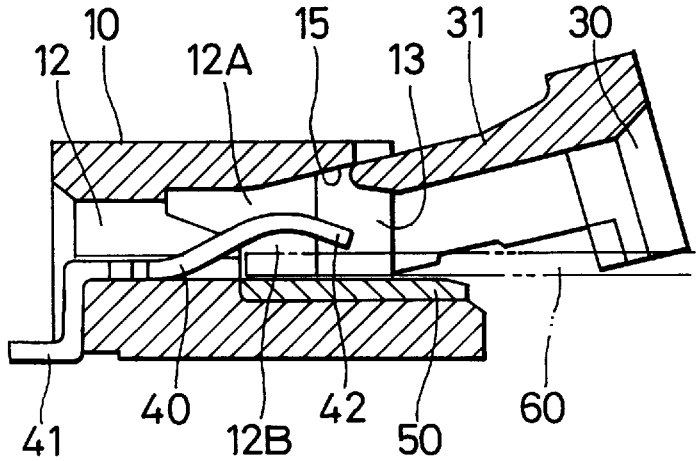
FIG. 11 is a cross-sectional view showing the interior of the cavity in the provisionally-retained condition.
Figure 12:
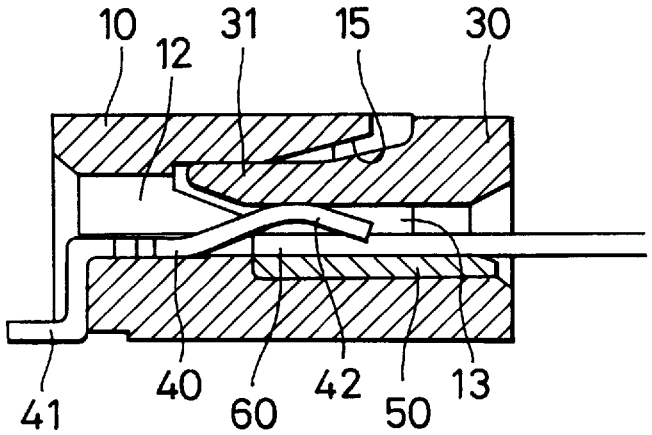
FIG. 12 is a cross-sectional view showing the interior of the cavity in the completely-retained condition, with the flat cable attached to the connector.
Figure 13:
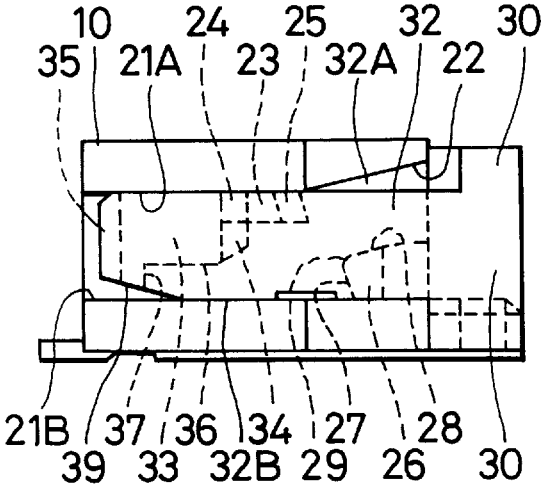
FIG. 13 is a side-elevational view showing the completely-retained condition.

In the completely-retained position, the press plate portion 31 is received in the slide member insertion space 12A to urge the metal terminals 40 downwardly to resiliently deform them, thereby holding the contact portions 42 of the metal terminals 40 in contact with the flat cable 60, as shown in FIG. 12. In the provisionally-retained position, the press plate portion 31 is positioned outwardly of the insertion port 13 of the cavity 12, and also assumes an upwardly-inclined posture relative to the flat cable 60 to be inserted, as shown in FIG. 11. As a result, the insertion of the flat cable 60 into the cavity 12 can be effected easily.

The construction of holding the slide member 30 in the provisionally-retained position and the completely-retained position relative to the housing 10, as well as the construction of guiding the movement of the slide member 30 between the two retained positions, is as follows.

Each of the guide grooves 11 in the housing 10 has a U-shaped cross-section, and upper and lower surfaces of the guide groove respectively define guide surfaces 21A and 21B parallel to the flat cable 60. Upper and lower surfaces 32A and 32B of the arm 32 are brought into contact with the guide surfaces 21A and 21B, respectively, so that the slide member 30 is guided forwardly and backwardly. That portion of the upper guide surface 21A through which the slide member 30 is first inserted defines the arm-guiding slanting surface 22 parallel to the press plate portion-guiding slanting surface 15 of the insertion port 13.

In each guide groove 11, a dual-purpose retaining projection 23, having a completely-retaining slanting surface 24 and a provisionally-retaining slanting surface 25, is formed on the right (and/or left) side surface adjacent the inner end of the arm-guiding slanting surface 22, and projects outwardly (perpendicularly from the sheet of FIG. 9B) The direction of inclination (that is, the slanting-down direction) of the provisionally-retaining slanting surface 25 of the dual-purpose retaining projection 23 is a direction of slanting obliquely upwardly right (FIG. 9B) relative to the horizontal guide surfaces 21A and 21B.

Figure 9A:
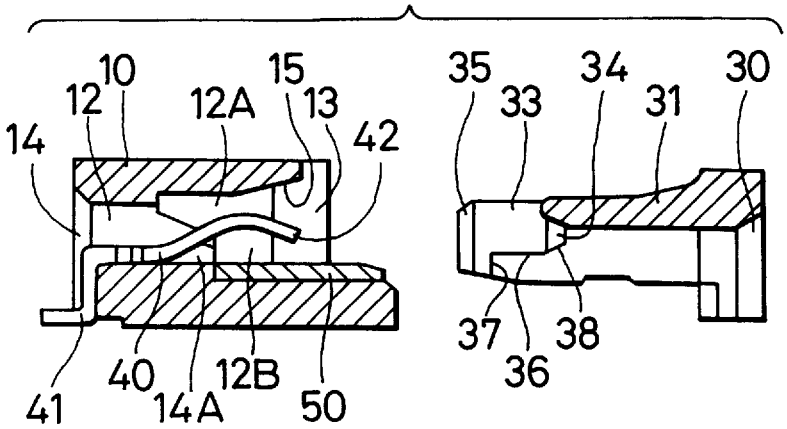
FIG. 9A is a cross-sectional view showing the interior of a cavity, with the slide member separated from the housing.
Figure 9B:
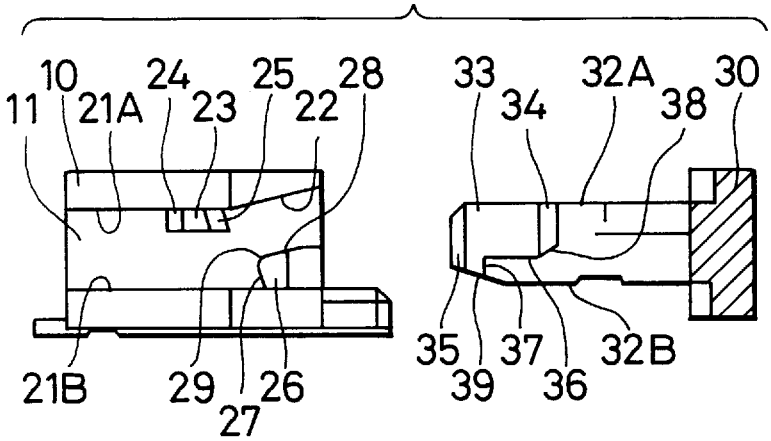
FIG. 9B is a partly-broken, cross-sectional view showing a construction of engagement between the housing and the slide member, with the slide member separated from the housing.
Figure 9C:
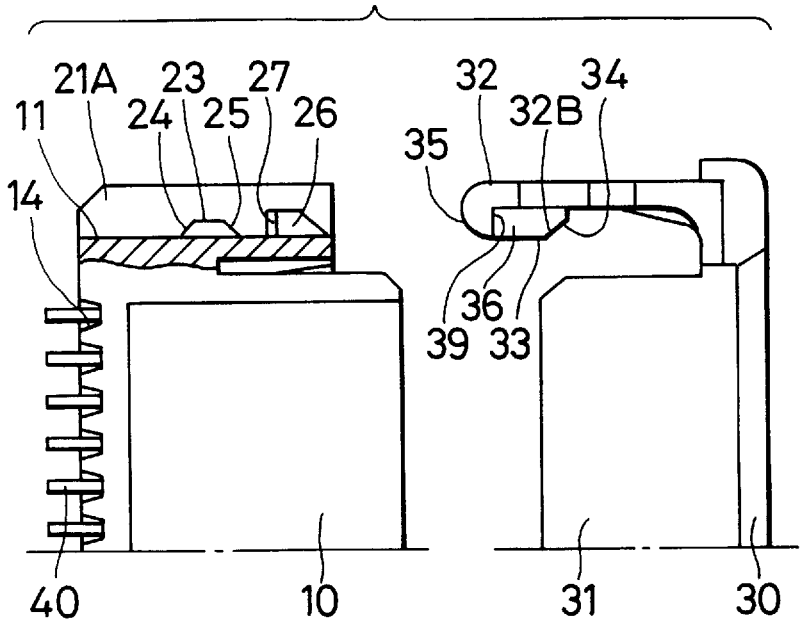
FIG. 9C is a partly-broken, bottom view, with the slide member separated from the housing.
Figure 10:
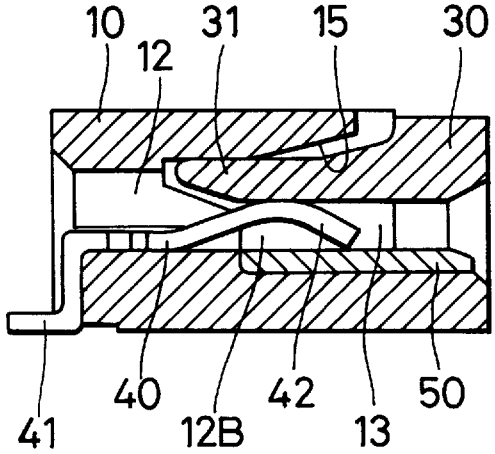
FIG. 10 is a cross-sectional view showing the interior of the cavity in the completely-retained condition, with a flat cable not attached to the connector.

A provisionally-retaining projection 26 is formed on the right (and/or left) side surface at a lower portion of each guide groove 11, and projects outwardly (perpendicularly from the sheet of FIG. 9C). The retaining projection 26 has at its left side (FIG. 9C) a provisionally-retaining abutment surface 27 that slants in a downward direction.

An upper surface of the provisionally-retaining projection 26 defines the slanting guide surface 28 parallel to the arm-guiding slanting surface 22. The slanting guide surfaces 28 serve to guide the slide member 30 in an upwardly-inclined posture during the movement of the slide member 30 toward the provisionally-retained position. A portion interconnecting the slanting guide surface 28 and the provisionally-retaining abutment surface 27 is defined by a smoothly-curved surface 29.

On the other hand, a retaining protuberance 33 is formed on the inner side of each arm 32 at a distal end portion thereof, and has a completely-retaining slanting surface 34 for contact with the completely-retaining slanting surface 24 of the housing 10. A provisionally-retaining abutment surface 37, corresponding to the provisionally-retaining abutment surface 27 of the housing 10, is formed in the lower side of the retaining protuberance 33 at a notched portion thereof. A provisionally-retaining slanting surface 35, corresponding to the provisionally-retaining surface 25 of the housing 10, is formed at the foremost or distal end of the arm 32.

Figure 14:
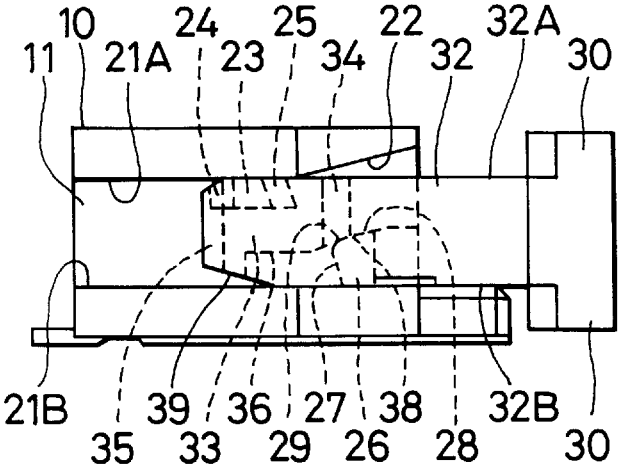
FIG. 14 is a side-elevational view showing a condition in which the slide member is disposed in a horizontal posture between the completely-retained position and the provisionally-retained position.

The lower surface of the notched portion of the retaining protuberance 33 is parallel to the upper surface of the arm 32, and defines a guided surface 36 for contact with the slanting guide surface 28 of the housing 10. An end portion of the guided surface 36 adjacent to the completely-retaining slanting surface 34 defines an upwardly-slanting guided surface 38 corresponding to the slanting guide surface 28. When the arm 32 assumes such a posture that its upper and lower surfaces 32A and 32B are in contact with the guide surfaces 21A and 21B, respectively, the angle of inclination of the slanting guided surface 38 relative to the guide surfaces 21A and 21B is slightly larger than that of the slanting guide surface 28, as shown in FIG. 14. When the slide member 30 is to be moved toward the provisionally-retained position, the slanting guided surface 38 contacts the interconnecting portion interconnecting the slanting guide surface 28 and the curved surface 29.

A slanting relief surface 39 is formed on a distal end portion of the lower surface 32B of the arm 32, and is slanting upwardly toward the distal end thereof. The angle of inclination of the slanting relief surface 39 relative to the lower surface 32B of the arm 32 is equal to the angle of inclination of the slanting guide surface 28 relative to the guide surfaces 21A and 21B.

The operation of this embodiment will now be described.

The arms 32 of the slide member 30 are engaged respectively in the guide grooves 11 in the housing 10, and then the slide member 30 is forced forwardly to insert the press plate 31 into the cavity 12, so that each arm is elastically deformed, and the retaining protuberance 33 slides past the provisionally-retaining projection 26 and the dual-purpose retaining projection 23 of the housing 10. Then, each completely-retaining slanting surface 34 of the slide member 30 is retainingly engaged with the associated completely-retaining slanting surface 24 of the housing, thereby holding the slide member 30 in the completely-retained condition relative to the housing 10, as shown in FIGS. 6, 10, 13 and 17. The connector, having the slide member 30 thus attached to the housing 10, is mounted on the printed circuit board (not shown), so that the contact portions 41 of the metal terminals 40 are connected to the respective circuit contacts (not shown) on the printed circuit board.

In this condition, for attaching the flat cable 60 to the connector, the slide member 30 is drawn relative to the housing 10, so that the slide member 30 is moved parallel in a horizontal posture, with the upper and lower surfaces 32A and 32B of each arm 32 held in contact with the associated guide surfaces 21A and 21B, respectively, and the slanting guided surface 38 comes into contact with the interconnecting portion interconnecting the slanting guide surface 28 and the curved surface 29, as shown in FIG. 14. At this time, the slanting guided surface 38 and the slanting guide surface 28 are slanting in the same direction at small angles relative to the direction of movement of the slide member 30, and also the angle of inclination of the slanting guided surface 38 is slightly larger than that of the slanting guide surface 28. Therefore, the edge of the slanting guided surface 38 at its distal end will not abut against the slanting guide surface 28, and therefore the slanting guided surface 38 is brought into smooth sliding contact with the slanting guide surface 28. Thus, an impact rarely occurs when the two slanting surfaces 28 and 38 are brought into contact with each other.

Figure 15:
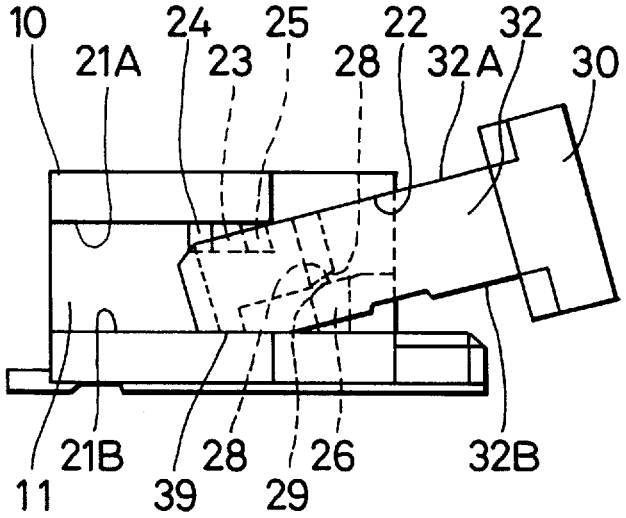
FIG. 15 is a side-elevational view showing a condition in which the slide member is disposed in an inclined posture between the completely-retained position and the provisionally-retained position.

In this condition, when the slide member 30 is further drawn, the slanting guided surface 38 slides over the slanting guide surface 28, so that the slide member 30 is smoothly brought into an inclined posture, as shown in FIG. 15. As a result, the upper surface 32A of the arm 32 contacts the arm-guiding slanting surface 22, and the slanting relief surface 39 of the arm 32 contacts the guide surface 21B, and the press plate portion 31 contacts the press plate portion-guiding slanting surface 15 within the cavity 12, and then the guided surface 36 slides over the slanting guide surface 28.

At this time, the corner of an obtuse angle (into which the slanting guided surface 38 and the guided surface 36 merge) contacts the curved surface 29, and therefore the posture of the slide member 30 can be smoothly changed in such a manner that the slide member 30 is not caught.

Figure 16:
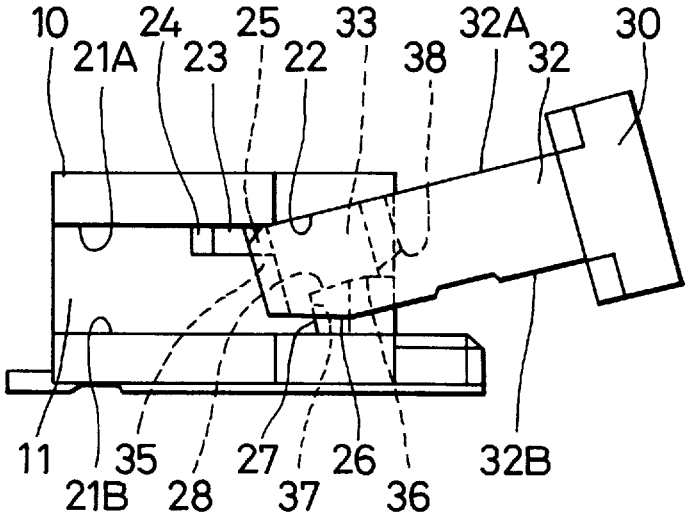
FIG. 16 is a side-elevational view showing the provisionally-retained condition.
Figure 17:
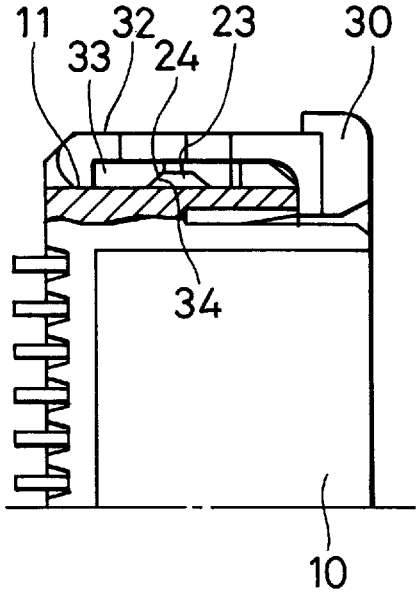
FIG. 17 is a partly-broken bottom view showing the completely-retained condition.
Figure 18:
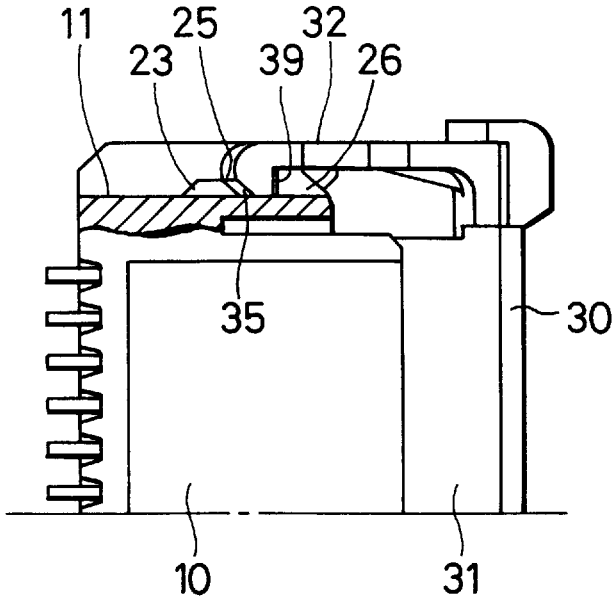
FIG. 18 is a partly-broken bottom view showing the provisionally-retained condition.
Figure 19:
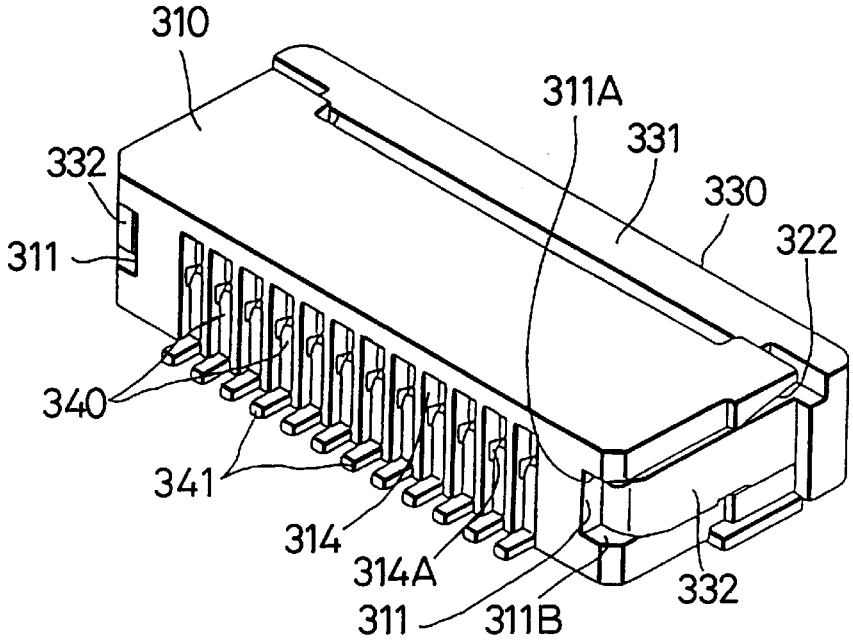
FIG. 19 is a perspective view of a second embodiment of a connector of the invention in a completely-retained condition.
Figure 20:
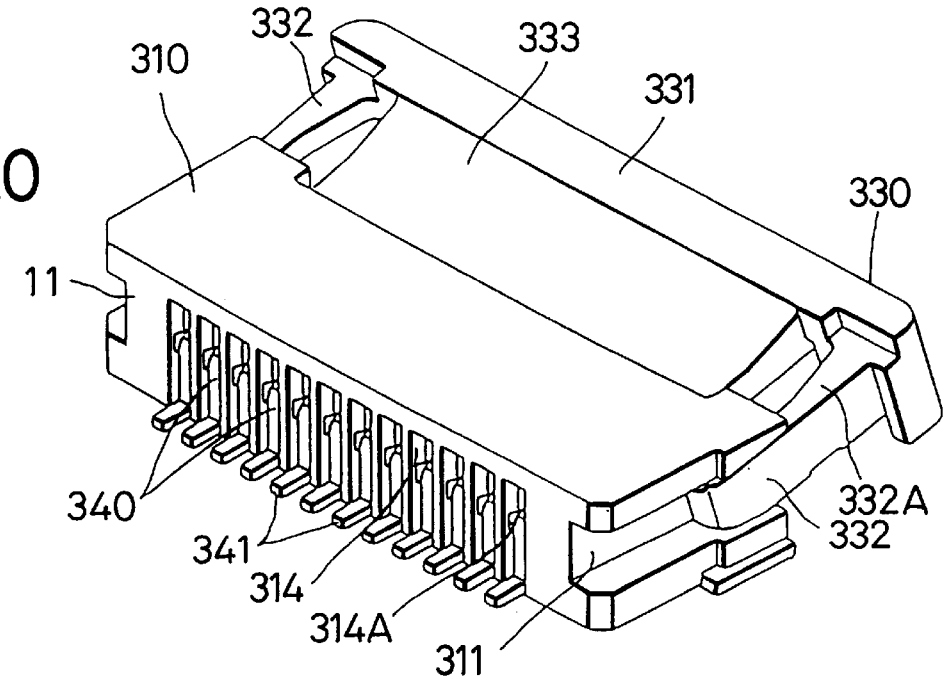
FIG. 20 is a perspective view of the connector in a provisionally-retained condition.

Then, when the slide member 30 is further drawn, the slide member 30 is moved parallel obliquely upwardly while being held in the predetermined posture because of contact between the upper surface 32A of each arm 32 and the associated arm-guiding slanting surface 22, the slanting relief surface 39 of each arm 32 and the associated guide surface 21B, the press plate portion 31 and the press plate portion-guiding slanting surface 15 and each guide surface 36 and the associated slanting guide surface 28. Then, when the slide member 30 reaches the provisionally-retained position as shown in FIG. 16, the slide member 30 is held in the provisionally-retained position against movement because of contact between the provisionally-retaining slanting surfaces 25 and 35 and between the provisionally-retaining abutment surfaces 27 and 37.

In this provisionally-retained position, the press plate portion 31 of the slide member 30 is inclined upwardly to a large extent at a position outwardly of the insertion port 13 of the cavity 12, and therefore the flat cable 60 can be easily inserted into the cavity 12.

After the flat cable 60 is thus inserted, the slide member 30 is forced into the housing 10. As a result, the slide member 30 moves obliquely downwardly, and is brought into a horizontal posture, and reaches the completely-retained position according to a procedure reverse to the above-mentioned procedure, and the slide member 30 is held in the completely-retained position because of the engagement between the completely-retaining slanting surfaces 24 and 34. In accordance with the movement of the slide member 30 toward the completely-retained position, the press plate portion 31 urges the metal terminals 40 downwardly to resiliently deform them within the cavity 12, so that the metal terminals 40 are brought into contact with the respective terminal contacts on the flat cable 60. As a result, the terminal contacts (not shown) on the flat cable 60 are connected to the respective circuit contacts of the printed circuit board through the respective metal terminals 40.

As described above, in the connector of this embodiment, the slide member 30 can be smoothly changed into the inclined posture without interrupting the movement thereof toward the provisionally-retained position by guiding the slide member 30 in accordance with the inclinations of the slanting guide surface 28 and the slanting guided surface 38. Therefore, the drawing operation, which has been cumbersome in the conventional construction because of the change in the drawing direction during the drawing operation, is not cumbersome, and therefore the efficiency of the operation is excellent. Besides, impact rarely occurs when the slanting guided surface 38 comes into contact with the slanting guide surface 28, and therefore there is little or no possibility that the fingers holding the slide member are disengaged therefrom because of the impact reaction as in the conventional construction. In this respect, the operation efficiency is excellent. Furthermore, because there is almost no impact upon contact of the slanting guided surface 38 with the slanting guide surface 28, a feel of being caught is not obtained through the fingers holding the slide member 30, so that a feeling of the operation is good.

The present invention is not to be limited to the embodiment described above with reference to the drawings, and for example, the following modifications fall within the scope of the invention, and other various modifications can also be made without departing from the scope of the invention.

(1) In the above embodiment, the maximum height of the lower surface of the press plate portion 31 of the slide member 30 in the provisionally-retained position can be set to a desired level by changing the angle of inclination of the slanting guide surfaces 28.

(2) In the above embodiment, in the case where the maximum height of the lower surface of the press plate portion 31 of the slide member 30 in the provisionally-retained position is constant, the angle of inclination of the slanting guide surface 28 can be made gentle by providing the slanting guide surface 28 at a position remote from the insertion port 13. With this arrangement, a more smooth operation feeling can be obtained.

(3) In the above embodiment, although the metal terminals 40 are held between the slide member 30 and the flat cable 60, the invention can be applied to a connector of the type in which the flat cable is held between the slide member and the metal terminals.

2nd Embodiment

A second embodiment of the present invention will now be described with reference to FIGS. 19 to 27.

A connector of this embodiment for a flat cable comprises a housing 310 of a non-electrically-conductive synthetic resin material, a slide member 330 of a non-electrically-conductive synthetic resin material, a plurality of metal terminals 340 of electrically-conductive metal and a holder 350 of electrically-conductive metal.

The housing 310 has a rectangular parallelepipedic shape as a whole, having a relatively small thickness between upper and lower surfaces thereof, and a relatively large width between right and left sides thereof. A pair of guide grooves 311 are formed for guiding the movement of the slide member 330 between a completely-retained position and a provisionally-retained position in the opposite (right and left) side surfaces of the housing 310, respectively. A plurality of holding holes 314 are formed in a rear surface of the housing 310, and are juxtaposed in a right-left direction, the holding holes 314 being separated from one another at a distance corresponding to the spacing of the metal terminals 340, respectively. Each metal terminal 340 extending through the associated holding hole 314 is retained against withdrawal by a retaining groove 314A in the holding hole 314. A cavity 312 is formed in the housing 310, and is open, as an insertion port 313, to a front surface of the housing 310.

Each of the guide grooves 311 has a pair of parallel upper and lower guide surfaces 311A and 311B each extending in a forward-rearward direction. Upper and lower surfaces 332A and 332B of each of arms 332 of the slide member 330 contact the two guide surfaces 311A and 311B of a respective one of the two guide grooves 311, respectively, so as to guide the slide member 330 in the forward-rearward direction. That portion (the right portion in FIGS. 25 and 26) of the upper guide surface 311A through which the slide member 330 is first inserted defines the arm-guiding slanting surface 322 that slants upwardly right. A completely-retaining slanting surface 324 and a provisionally-retaining slanting surface 325 are formed at an upper portion of the guide groove 311, and a provisionally-retaining abutment surface 327 and a slanting guide surface 328 (which is parallel to the arm-guiding slanting surface 322) are formed at a lower portion of the guide groove 311.

Figure 21:
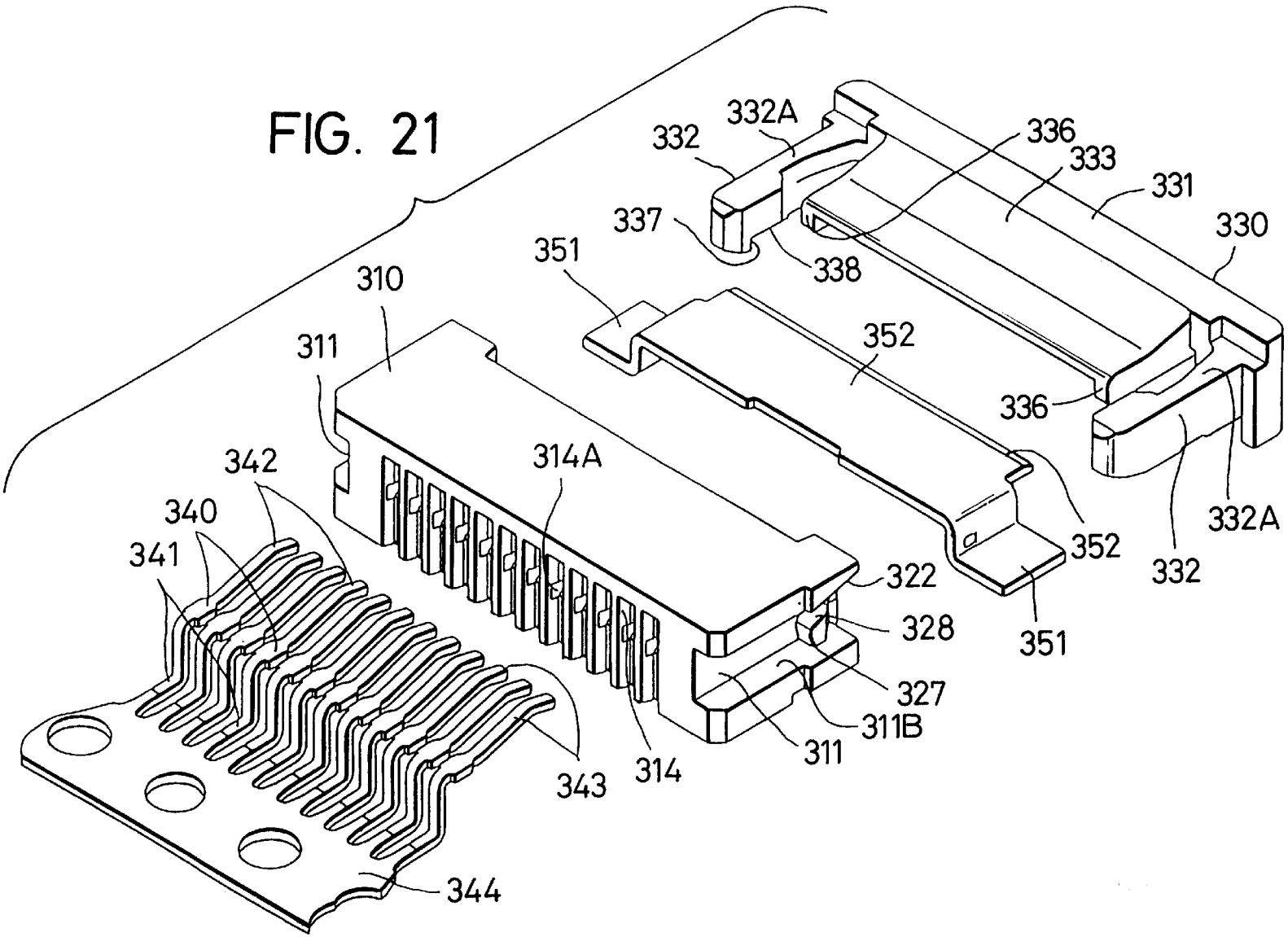
FIG. 21 is a perspective view showing a housing, a slide member, metal terminals and a holder separated from one another.
Figure 22:
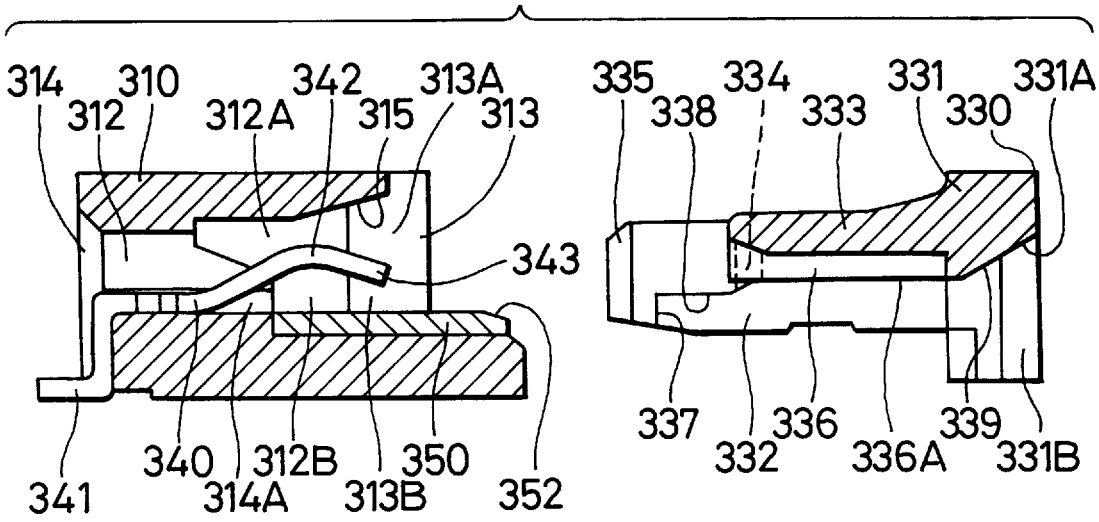
FIG. 22 is a cross-sectional view showing a condition in which the slide member is separated from the housing.

Each metal terminal 340 extending through the associated holding hole 314 is retained against withdrawal by the retaining groove 314A in the holding hole 314. Each metal terminal 340 has a printed board-side contact portion 341 of a crank-shape exposed to the exterior of the housing 10. A convexly-curved clamping portion 342 of the metal terminal 340 remote from the printed board-side contact portion 341 projects into the cavity 312. A downwardly-slanting distal end portion of the clamping portion 342 defines a flat cable-side contact portion 343 for contact with a terminal contact (not shown) on the upper surface of the flat cable 360. In FIG. 21, although the plurality of metal terminals 340 are interconnected by a carrier 344, this carrier 344 is cut off from the metal terminals 340 after the metal terminals 340 are attached to the housing 310.

The holder 350 is fixedly secured to a bottom surface of the cavity 312 by fixing means (not shown). Legs 351, formed respectively at the opposite (right and left) ends of the holder 350, are adapted to be soldered to the printed circuit board, thereby fastening the housing 310 to the printed circuit board. A slanting surface 352 is formed on an outer end or edge (right end in FIGS. 23 and 24) of the holder 350 at the upper side thereof in the vicinity of the insertion port 313, and the slanting surface 352 facilitates the insertion of the flat cable 360 into the cavity 312.

The internal space of the cavity 312 is divided by the metal terminals 340 into an upper space and a lower space. More specifically, a flat cable insertion space 312B for receiving the flat cable 360 is formed between the clamping portions 342 (and the flat cable-side contact portions 343) of the metal terminals 340 and the holder 350 underlying the clamping portions 342. A slide member insertion space 312A is formed between the clamping portions 342 and a top surface of the cavity 312 overlying the clamping portions 342. The slide member insertion space 312A and the flat cable insertion space 312B are joined together at the insertion port 313, and are open to the exterior of the housing 310.

The top surface of the cavity 312 slants upwardly toward the insertion port 13 over a given distance to form a press plate portion relief slanting surface 315. The press plate portion relief slanting surface 315 is parallel to the arm-guiding slanting surfaces 322 and the slanting guide surfaces 328, and the slanting surfaces 315, 322 and 328 cooperate with one another to guide and hold the slide member 330 in a predetermined inclined posture in the provisionally-retained position.

The slide member 330 includes a body portion 331 of a generally U-shape matching the upper edge and opposite (right and left) edges of the insertion port 313 in the housing 310, a press plate portion 333 adapted to be inserted into the slide member insertion space 312A of the cavity 312 in the completely-retained condition, and a pair of arms 332 spaced a predetermined distance from each other, and formed respectively at opposite (right and left) sides of the press plate portion 333, the pair of arms 332 and 332 being engaged respectively in the guide grooves 311 and 311 in the housing 10.

The body portion 331 has outwardly-slanting surfaces 331A and 331B at its proximal portion remote from the press plate portion 333. The front end of the flat cable 360 contacts these outwardly-slanting surfaces 331A and 331B if the flat cable 360 is out of alignment with the insertion port 313 when inserting the flat cable 360, and because of the inclination of the outwardly-slanting surfaces 331A and 331B, the front end of the flat cable 360 is properly guided toward the insertion port 313.

A guide surface 339, which slant downwardly inwardly, is formed on the body portion 331, and is continuous with the outwardly-slanting surface 331A. A lower edge of the guide surface 339 projects downwardly beyond the lower surface of the press plate portion 333 over an entire length (or width) of the outwardly-slanting surface 331A. Like the outwardly-slanting surfaces 331A and 331B, the guide surface 339 serves to guide the flat cable 360 downwardly toward the insertion port 313.

The inner surface of each arm 332 includes a completely-retaining slanting surface 334 engageable with the completely-retaining slanting surface 324 of the housing 310, a provisionally-retaining abutment surface 337 engageable with the provisionally-retaining abutment surface 327 of the housing 310, a provisionally-retaining slanting surface 335 engageable with the provisionally-retaining slanting surface 325 of the housing 310, and a slanting guided surface 338 that is parallel to the upper and lower surfaces 332A and 332B of the arm 332, the slanting guided surface being contactable with the slanting guide surface 328 of the housing 310.

Figure 25:
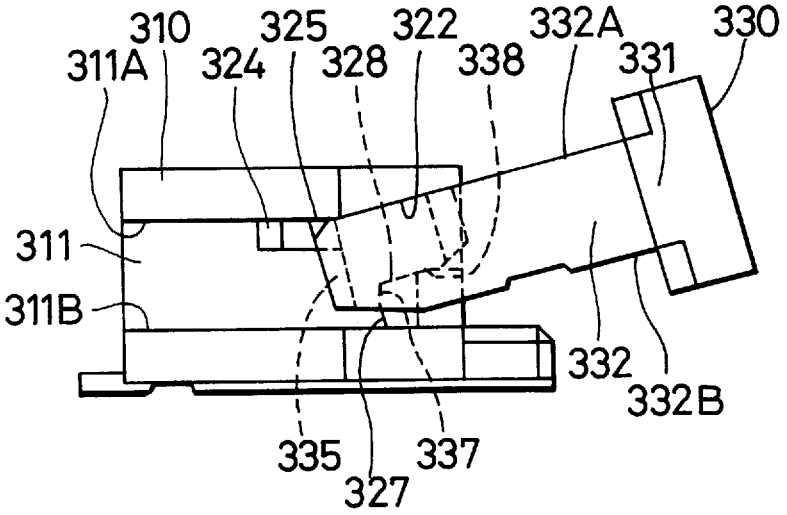
FIG. 25 is a side-elevational view showing the provisionally-retained condition.
Figure 26:
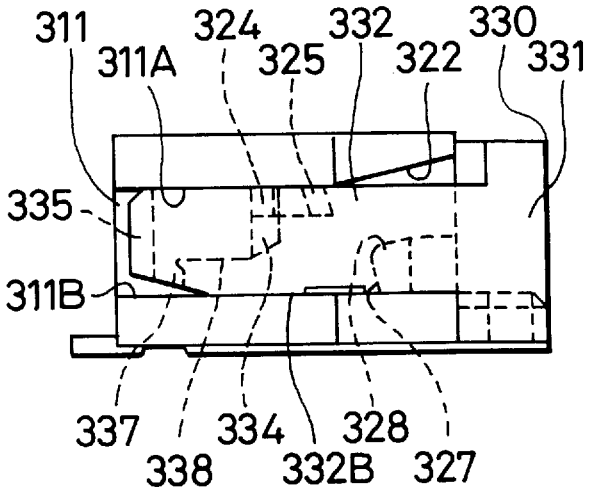
FIG. 26 is a side-elevational view showing the completely-retained condition.

The slide member 330 is held in the completely-retained position by the engagement of each completely-retaining slanting surface 334 with the associated completely-retaining slanting surface 324, as shown in FIG. 26. The slide member 330 is held in the provisionally-retained position by the engagement of each provisionally-retaining slanting surface 335 with the associated provisionally-retaining slanting surface 325 and by the engagement of each provisionally-retaining abutment surface 337 with the associated provisionally-retaining abutment surface 327, as shown in FIG. 25. In the provisionally-retained position, because of the contact between the upper surface 332A of the arm 332 and the arm-guiding slanting surface 322 and the contact between the slanting guided surface 338 and the slanting guide surface 328, the slide member 330 is retained in such a manner that the press plate portion 333 is inclined at a predetermined angle.

Figure 24:
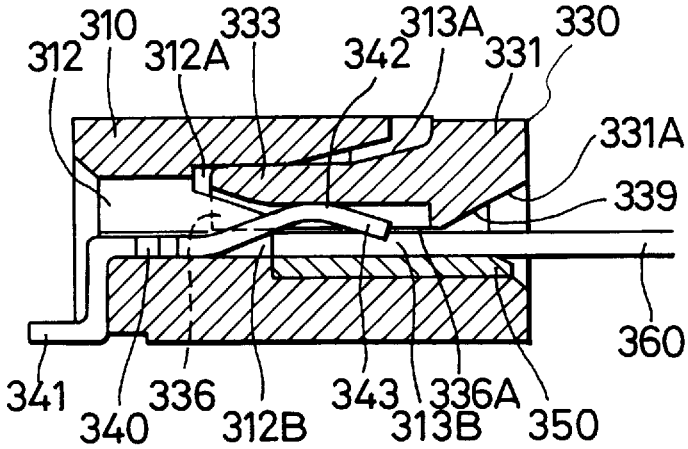
FIG. 24 is a cross-sectional view showing the interior of the cavity in the completely-retained condition in which a flat cable is attached to the connector.

In the completely-retained position, the press plate portion 333 is received in the slide member insertion space 312A, and elastically deforms and urges the metal terminals 340 downwardly, so that the flat cable-side contact portions 343 are held in contact with the flat cable 360 received in the flat cable insertion space 312B, as shown in FIG. 24.

Figure 23:
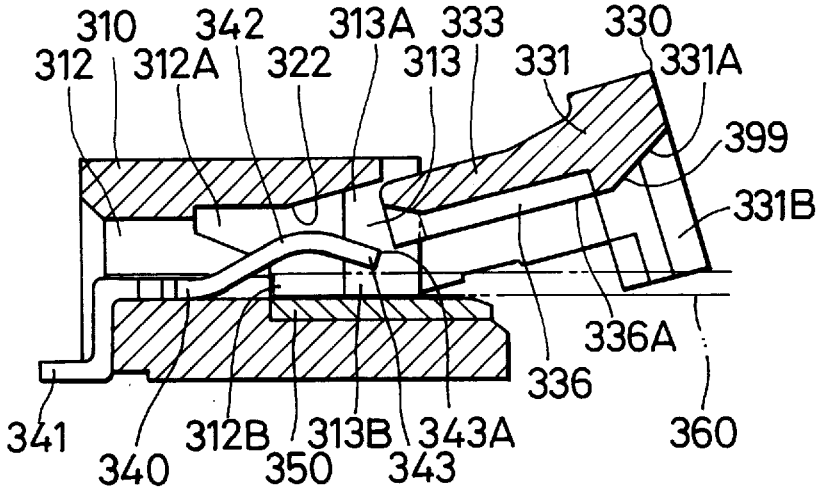
FIG. 23 is a cross-sectional view showing the interior of a cavity in the provisionally-retained condition.

In the provisionally-retained position, the press plate portion 333 is disposed in a position outwardly of the insertion port 313 of the cavity 312, and is inclined outwardly upwardly relative to the flat cable 360 to be held in the completely-retained position, as shown in FIG. 23. In this condition, an open portion 313B of the flat cable insertion space 312B and an open portion 313A of the slide member insertion space 312A are fully open to the exterior of the housing 310. The press plate portion 333 extends obliquely from the upper edge of the insertion port 313 generally in continuous relation to the insertion port 313, SO that the area of opening of the cavity 312 to the exterior of the housing 310 is substantially larger than the insertion port 313. This facilitates the insertion of the flat cable 360 into the cavity 312.

A pair of erroneous insertion prevention piece portions 336 is formed respectively at opposite (right and left) side edges of the press plate portion 333, and project downwardly therefrom. The piece portions 336 serve as means for preventing the flat cable 360 from being erroneously inserted into the slide member insertion space 312A. In the provisionally-retained condition in which the press plate portion 333 is held in the inclined posture, the distal end (left end in FIG. 23) of each erroneous insertion prevention piece portion 336 is disposed in a lowermost position, and the height of the lowermost end of the erroneous insertion prevention piece portion 336 is generally at the same level as that of an upper edge 343A of the distal end of the flat cable-side contact portion 343 of each metal terminal 340. Therefore, the erroneous insertion prevention piece portions 336 project respectively into opposite (right and left) side portions of the open portion 313A of the slide member insertion space 312A.

Figure 27:
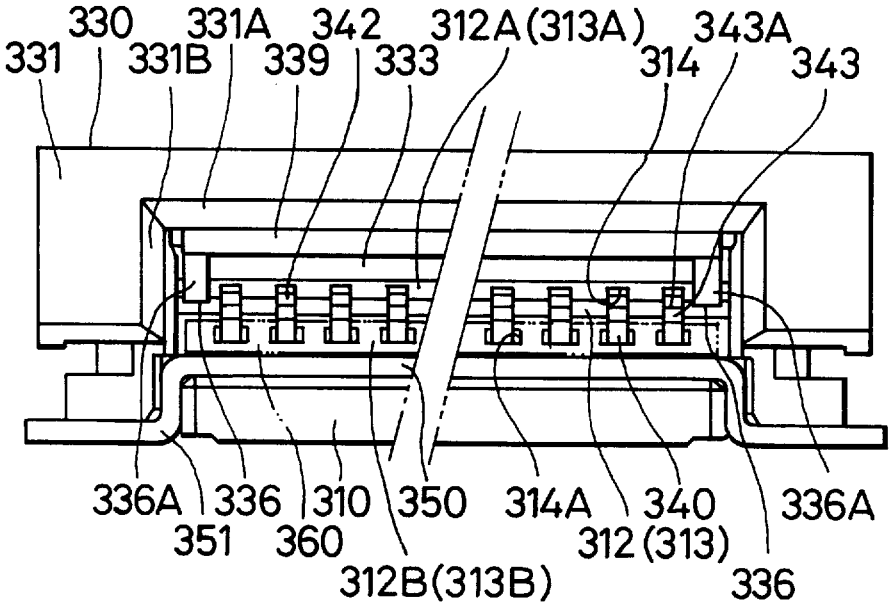
FIG. 27 is a front-elevational view showing the provisionally-retained condition.

As shown in FIG. 27, the pair of erroneous insertion prevention piece portions 336 are disposed outwardly of the opposite outermost ones of the row of metal terminals 340 in the cavity 312, respectively. Therefore, when the press plate portion is inserted into the cavity 312 in the completely-retained position, the erroneous insertion prevention piece portions 336 will not interfere with the metal terminals 340.

The distance between the two erroneous insertion prevention piece portions 336 is smaller than the width of the flat cable 360. Therefore, the flat cable 360 will not pass between the two erroneous insertion prevention piece portions 336 when inserting the flat cable 360 into the insertion port 313. The two erroneous insertion prevention piece portions 336 are disposed near to the opposite (right and left) sides of the insertion port 313, and therefore, even if the flat cable 360 is displaced right or left when it is to be inserted into the insertion port 313, the flat cable 360 will come into contact with one or both of the erroneous insertion prevention piece portions 336.

The lower surface of each erroneous insertion prevention piece portion 336 is generally parallel to the lower surface of the press plate portion 333, and defines a guide surface 336A continuous with the lower edge of the guide surface 339 of the body portion 331. Like the guide surface 339 of the body portion 331, the guide surfaces 336A of the press plate portion 333 serve to guide the flat cable 360 downwardly toward the insertion port 313.

The operation of this embodiment will now be described.

When the flat cable 360 is to be attached to the connector of this embodiment, the slide member 330 is moved to the provisionally-retained position. In the provisionally-retained position, the press plate portion 333 of the slide member 330 is held much inclined upwardly at a position outwardly of the insertion port 313 of the cavity 312, and the erroneous insertion prevention piece portions 336 project respectively at the opposite sides of the open portion 313A of the slide member insertion space of the insertion port 313, as shown in FIG. 23.

Therefore, if the flat cable 360 begins to advance not toward the open portion 313B of the flat cable insertion space 312B but toward the open portion 313A of the slide member insertion space 312A overlying the flat cable insertion spade 312B, the front end of the flat cable 360 abuts at its opposite side portions against the guide surface 339 of the body portion 331 of the slide member 330 or the guide surfaces 336A of the erroneous insertion prevention piece portions 336. Then, as the insertion of the flat cable 360 is continued, the front end of the flat cable 360 is guided downwardly in accordance with the inclination of the guide surfaces 339 and 336A, and finally reaches the open portion 313B of the flat cable insertion space 312B, and is inserted into the flat cable insertion space 312B.

After the flat cable 360 is thus inserted, the slide member 330 is moved to the completely-retained position to insert the press plate portion 333 into the slide member insertion space 312A through the open portion 313A. As a result, within the cavity 312, the clamping portions 342 of the metal terminals 340 are pressed downwardly by the press plate portion 333, and are connected to the respective terminal contacts (not shown) on the upper surface of the flat cable 360, as shown in FIG. 24.

At this time, because the erroneous insertion prevention piece portions 336, projecting downwardly from the press plate portion 333, are disposed outwardly of the opposite outermost ones of the row of metal terminals 340, respectively, these prevention piece portions 336 will not interfere with the metal terminals 340. Therefore, the press plate portion 333 can be easily inserted into the slide member insertion space 312A with little effort. Also, the press plate portion 333 and the metal terminals 340 will not be damaged or deformed through the interference of the erroneous insertion prevention piece portions with the metal terminals 340.

As described above, in the connector of this embodiment, because the erroneous insertion prevention piece portions 336 can project into the open portion 313A of the slide member insertion space 312A, the flat cable 360 can be prevented from being erroneously inserted into the slide member insertion space 312A.

In this embodiment, particularly, because the guide surfaces 336A of the erroneous insertion prevention piece portions 336 can contact with the flat cable 360 to guide the flat cable toward the open portion 313B of the flat cable insertion space 312B, the flat cable 360, abutted against the erroneous insertion prevention piece portions 336, does not need to be re-inserted after once moving it back, and therefore the insertion of the flat cable 360 can be effected easily.

3rd Embodiment

Figure 28:
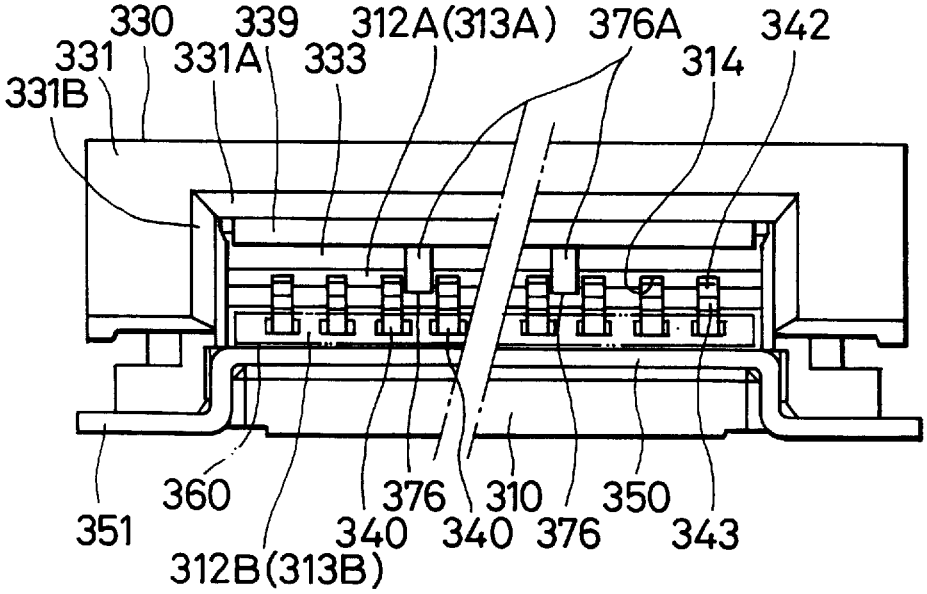
FIG. 28 is a front-elevational view of a third embodiment of a connector of the invention in a provisionally-retained condition.

A third embodiment of the present invention will now be described with reference to FIG. 28.

In the connector of this embodiment, the positions of erroneous insertion prevention piece portions are different from those of the erroneous prevention piece portions in the second embodiment. The other construction is the same as that of the second embodiment, and therefore, the same portions will be designated by identical reference numerals, respectively, and explanation of such construction, operation and advantageous effects thereof will be omitted.

The erroneous insertion prevention piece portions 376 of this embodiment have the same overall configuration and dimensions as those of the erroneous insertion prevention piece portions 336 of the second embodiment. The two erroneous insertion prevention piece portions 376 of this embodiment are not provided respectively at opposite (right and left) side edges of an press plate portion 333, but are provided respectively at two suitable positions that divide the press plate portion 333 into three sections in the right-left direction. Each of the two erroneous insertion prevention piece portions 376 is provided such that each can be disposed in vertical registry with the gap between the corresponding adjacent metal terminals 340. Therefore, in a completely-retained condition, the erroneous insertion prevention piece portions 376 will not interfere with the metal terminals 340.

In the connector of this embodiment, also, as in the second embodiment, even if the flat cable 360 advances toward a slide member insertion space 312A, a front end of the flat cable 360 abuts against guide surfaces 376A of the erroneous insertion prevention piece portions 376, and is guided toward an open portion 313B of a flat cable insertion space 312B in accordance with the inclination of the guide surfaces 376A. Therefore, the flat cable 360 will not be erroneously inserted into the slide member insertion space 312A, and can be inserted into the flat cable insertion space 312B easily and surely.

4th Embodiment

Figure 29:
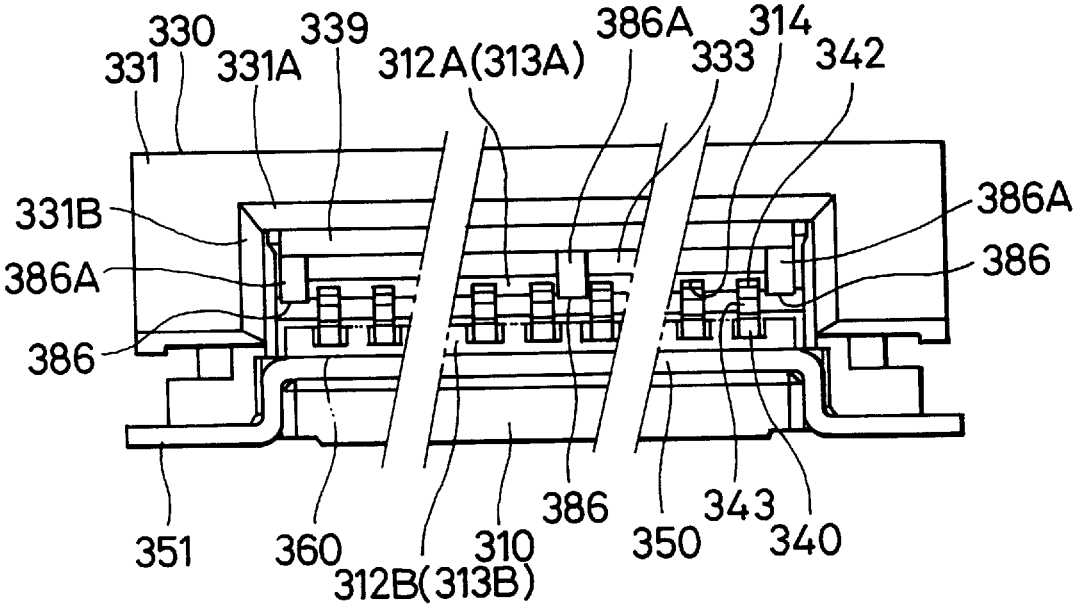
FIG. 29 is a front-elevational view of a fourth embodiment of a connector of the invention in a provisionally-retained condition.

A fourth embodiment of the present invention will now be described with reference to FIG. 29.

In a connector of this embodiment, the positions of erroneous insertion prevention piece portions are different from those of the erroneous prevention piece portions in the second and third embodiments. The other construction is the same as that of the second embodiment, and therefore the same portions will be designated by identical reference numerals, respectively, and explanation of such construction, operation and advantageous effects thereof will be omitted.

The erroneous insertion prevention piece portions 386 of this embodiment have the same overall configuration and dimensions as those of the erroneous insertion prevention piece portions 336 and 376 of the second and third embodiments. Two of the erroneous insertion prevention piece portions 386 of this embodiment are provided respectively at opposite (right and left) side edges of a press plate portion 333 as in the second embodiment. Additionally, the other erroneous insertion prevention piece portion 386 is provided at a central portion of the press plate portion 333 intermediate the opposite sides thereof. Each of the three erroneous insertion prevention piece portions 386 is provided such that it can be disposed out of vertical registry with the metal terminals 340. Therefore, in a completely-retained condition, the erroneous insertion prevention piece portions 386 will not interfere with the metal terminals 340.

In the connector of this embodiment, also, as in the second and third embodiments, the flat cable 360, advancing toward a slide member insertion space 312A, is guided toward an open portion 313B of a flat cable insertion space 312B by guide surfaces 386A of the erroneous insertion prevention piece portions 386. Therefore, the flat cable 360 can be inserted into the flat cable insertion space 312B easily and surely.

5th Embodiment

Figure 30:
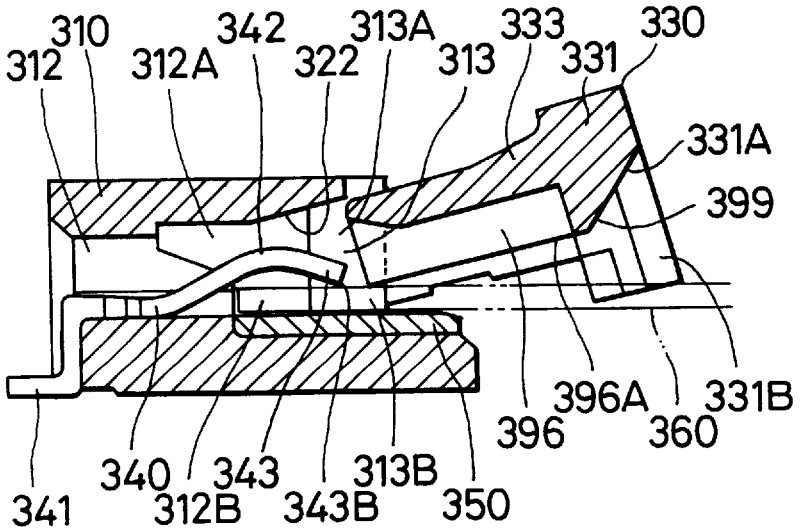
FIG. 30 is a cross-sectional view of a fifth embodiment of a connector of the invention showing the interior of a cavity in a provisionally-retained condition.

A fifth embodiment of the present invention will now be described with reference to FIG. 30.

Erroneous insertion prevention piece portions of this embodiment differ in configuration and dimensions from those of the above embodiments. The other construction is the same as that of the second embodiment, and therefore the same portions will be designated by identical reference numerals, respectively, and explanation of such construction, operation and advantageous effects thereof will be omitted.

The dimension of downwardly-projecting of the erroneous insertion prevention piece portions 396 of this embodiment from a press plate portion 333 is larger than that of the above embodiments. More specifically, the height of a lower edge of a distal end (left end in FIG. 30) of each erroneous insertion prevention piece portion 396, disposed at the lowermost position in a provisionally-retained condition, is generally at the same level as that of a lower edge 343B of the distal end of the flat cable-side contact portion 343 of each metal terminal 340.

The erroneous insertion prevention piece portions 396 are provided on the press plate portion 333 at the same positions as in the above embodiment, or at other suitable positions. A guide surface 399 of a body portion 331, which is continuous with a guide surface 396A of each erroneous insertion prevention piece portion 336, extends downwardly beyond the guide surface 399 of the above embodiments.

In the connector of this embodiment, the front end of the flat cable 360 inserted toward the slide member insertion space 312A abuts against the guide surfaces 396A of the erroneous insertion prevention piece portions 396, and are guided by these guide surfaces 396A. Then, the front end of the flat cable 360, immediately after passing past the extremities of the guide surfaces 396A, passes below the flat cable-side contact portions 343 of the metal terminals 340 without contacting them, and are guided toward the open portion 313 of the flat cable insertion space 312B. Therefore, the front end of the flat cable 360 will not abut against the distal end surfaces of the flat cable-side contact portions 343, and therefore damage to the flat cable 360 and deformation of the metal terminals 340 due to the abutment of the flat cable 360 against the flat cable-side contact portions 343 are prevented.

The present invention is not limited to the embodiments described above with reference to the drawings, and for example, the following modifications fall within the scope of the invention, and other modifications can also be made without departing from the scope of the invention.

(1) In the present invention, the erroneous insertion prevention piece portions do not always need to be provided on the press plate portion 333 at those positions (spaced from one another in the right-left direction) described in the second, third and fourth embodiments, and the erroneous insertion prevention piece portions may be provided at any suitable positions in so far as they can project into the open portion of the slide member insertion space 312A so as to prevent the erroneous insertion of the flat cable 360.

(2) The lower edge of the distal end of each erroneous insertion prevention piece portion, which is disposed at the lowermost position in the provisionally-retained position, may be disposed at a level higher than that of the lower edge of the distal end of the erroneous insertion prevention piece portions 336, 376, 386 of the 2nd to 4th embodiments. In this case, if the gap between the distal end of the erroneous insertion prevention piece portion and the metal terminals 340 is smaller than the thickness of the flat cable 360, the erroneous insertion of the flat cable 360 into the slide member insertion space 312A is prevented.

(3) The lower edge of the distal end of each erroneous insertion prevention piece portion, which is disposed at the lowermost position in the provisionally-retained position, may be disposed at a level lower than that of the lower edge of the distal end of the erroneous insertion prevention piece portions 396 of the fifth embodiment. In this case, if the gap between the distal end of the erroneous insertion prevention piece portion and the holder 350 is larger than the thickness of the flat cable 360, the flat cable 360 can be inserted into the flat cable insertion space 312B.

(4) In the above embodiments, although the press plate portion of the slide member is inclined upwardly outwardly relative to the insertion port in the provisionally-retained position, the present invention can be applied to a connector of the type in which a press plate portion is not inclined but is held in a horizontal posture relative to an insertion port.

(5) In the above embodiments, although the open portion of the slide member insertion space and the open portion of the flat cable insertion space are continuous with each other to form the single insertion port, the present invention can be applied to the type in which such two open portions are isolated from each other in closely spaced relation to each other.

(6) In the above embodiments, although the guide surface is formed on each erroneous insertion prevention piece portion for guiding the flat cable toward the flat cable insertion space, the present invention can be of such a construction in which the guide surface is not provided on the erroneous insertion prevention piece portion, in which case the flat cable is brought into contact with the erroneous insertion prevention piece portions, thus merely limiting the insertion of the flat cable.

What is claimed is:

1. A connector for a flat cable comprising:

a housing having a cavity into which the flat cable is adapted to be inserted through an insertion port in said housing;

metal terminals mounted on said housing and insertable into said cavity;

a slide member displaceable relative to said housing between a completely-retained position and a provisionally-retained position, wherein said slide member is displaced into the provisionally-retained position to be held outwardly of said insertion port when the flat cable is to be inserted into said cavity, and said slide member is displaced into the completely-retained position to be inserted into said cavity to thereby hold said metal terminals in contact with the flat cable;

a first slanting guide surface formed on said housing, said slanting guide surface being inclined relative to a direction of insertion of the flat cable;

a second slanting guide surface formed on said slide member for slidingly contacting said first slanting guide surface during movement of said slide member toward the provisionally-retained position; and a third slanting guide surface formed on said housing;

wherein said second slanting guide surface is brought into sliding contact with said first slanting guide surface during the movement of said slide member toward the provisionally-retained position, thereby guiding said slide member into a posture inclined outwardly relative to said insertion port, and said third slanting guide surface guides said slide member in a direction of extension of said first slanting guide surface over a path of displacement of said slide member from a position where said second slanting guide surface is brought into sliding contact with said first slanting guide surface to the provisionally-retained position.

2. A connector for a flat cable comprising:

a housing having a cavity open to the exterior through an insertion port;

a slide member displaceable relative to said housing between a completely-retained position and a provisionally-retained position;

metal terminals mounted on said housing and insertable into said cavity to divide said cavity into a flat cable insertion space and a slide member insertion space, wherein, when a flat cable is to be inserted into said flat cable insertion space, said slide member is displaced to the provisionally-retained position to be disposed outwardly of said insertion port, said slide member being displaced into the completely-retained position to be inserted into said slide member insertion space so that said slide member presses said metal terminals into contact with said flat cable;

erroneous insertion prevention piece portions formed on said slide member, said erroneous insertion prevention piece portions projecting into an open portion of said insertion port, communicating with said slide member insertion space, in the provisionally-retained position, so that said erroneous insertion prevention piece portions are positioned to contact said flat cable, said erroneous insertion prevention piece portions projecting into the open portion of the insertion port to an extent such that the erroneous insertion piece portions abut a side surface defining the flat cable insertion space, thereby preventing erroneous insertion of said flat cable into the slide member insertion space;

a first slanting guide surface formed on said housing, said slanting guide surface being inclined relative to a direction of insertion of the flat cable;

a second slanting guide surface formed on said slide member for slidingly contacting said first slanting guide surface during movement of said slide member toward the provisionally-retained position; and a third slanting guide surface formed on said housing;

wherein second slanting guide surface is brought into sliding contact with said first slanting guide surface during the movement of said slide member toward the provisionally-retained position, thereby guiding said slide member into a posture inclined outwardly relative to said insertion port, and said third slanting guide surface guides said slide member in a direction of extension of said first slanting guide surface over a path of displacement of said slide member from a position where said second slanting guide surface is brought into sliding contact with said first slanting guide surface to the provisionally-retained position.

3. A connector according to claim 2, wherein each of said erroneous insertion prevention piece portions has a guide surface for guiding said flat cable toward said flat cable insertion space in a direction away from said slide member insertion space.

4. A connector for a flat cable comprising:

a housing having a cavity;

a slide member positionable with respect to the cavity in a completely-retained position and a provisionally-retained position, said flat cable being inserted in the cavity when the slide member is in the provisionally-retained position; and guiding means for smoothly guiding the slide member in a first direction, up, and in a second direction different from said first direction, away from the housing in a continuous manner from the completely-retained position to the provisionally-retained position, thereby creating a gap between the slide member and the housing for allowing insertion of said flat cable within the housing, the guiding means including a first slanting guide surface formed on said housing, said slanting guide surface being inclined relative to a direction of insertion of the flat cable, a second slanting guide surface formed on said slide member for slidingly contacting said first slanting guide during movement of said slide member toward the provisionally-retained position, and a third slanting guide surface formed on said housing;

wherein said second slanting guide surface is brought into sliding contact with said first slanting guide surface during the movement of said slide member toward the provisionally-retained position, thereby guiding said slide member into a posture inclined outwardly relative to said insertion port, and said third slanting guide surface guides said slide member in a direction of extension of said first slanting guide surface over a path of displacement of said slide member from a position where said second slanting guide surface is brought into sliding contact with said first slanting guide surface to the provisionally-retained position.

5. A connector according claim 4, wherein said guiding means includes first portions formed on the slide member and second portions formed on the housing, said second portions guiding said slide member toward the provisionally-retained position during withdrawal of the slide member.

6. A connector according to claim 5, wherein said first and second portions also include stopping portions for maintaining the slide member in the provisionally retained position upon reaching the provisionally-retained position.

7. A connector according to claim 6, further comprising retaining engagement portions formed on the slide member and the housing that cooperate to maintain the slide member in the completely-retained position.

8. A connector according to claim 5, further comprising retaining engagement portions formed on the slide member and the housing that cooperate to maintain the slide member in a completely-retained position.

9. A connector according to claim 4, further comprising erroneous insertion prevention means for ensuring that the flat cable is inserted into a proper position in the housing.

10. A connector according to claim 9, wherein said erroneous insertion prevention means includes at least one erroneous insertion prevention piece formed on the slide member for guiding the flat cable to the proper position.

11. A connector for a flat cable comprising:

a housing having a cavity;

a slide member positionable with respect to said cavity in completely-retained and provisionally-retained positions; and guidance structure between the housing and the slide member for smoothly guiding the slide member from the completely-retained position to file provisionally-retained position along a substantially continuous, arcuate path, the guidance structure including a first slanting guide surface formed on said housing, said slanting guide surface being inclined relative to a direction of insertion of the flat cable, a second slanting guide surface formed on said slide member for slidingly contacting said first slanting guide surface during movement of said slide member toward the provisionally-retained position, and a third slanting guide surface formed on said housing;

wherein said second slanting guide surface is brought into sliding contact with said first slanting guide surface during the movement of said slide member toward the provisionally-retained position, thereby guiding said slide member into a posture inclined outwardly relative to said insertion port, and said third slanting guide surface guides said slide member in a direction of extension of said first slanting guide surface over a path of displacement of said slide member from a position where said second slanting guide surface is brought into sliding contact with said first slanting guide surface to the provisionally-retained position.

12. A connector for a flat cable according to claim 11, further comprising an erroneous insertion prevention piece formed on the slide member for guiding the flat cable to a proper position in the cavity.

13. A connector for a flat cable comprising:

a housing having a cavity that includes a flat cable insertion space and a slide member insertion space;

a slide member displaceable relative to the housing between a completely-retained position and a provisionally-retained position, the slide member having a plate insertable within the slide member insertion space of the cavity to clamp the flat cable;

at least one erroneous insertion prevention piece extending from the plate into the cavity for guiding the flat cable to a proper position within the cavity, the at least one insertion prevention piece portion extending from the plate into the cavity to an extent such that entry of the flat cable into the slide member insertion space is prevented;

a first slanting guide surface formed on said housing, said slanting guide surface being inclined relative to a direction of insertion of the flat cable;

a second slanting guide surface formed on said slide member for slidingly contacting said first slanting guide surface during movement of said slide member toward the provisionally-retained position; and a third slanting guide surface formed on said housing;

wherein said second slanting guide surface is brought into sliding contact with said first slanting guide surface during the movement of said slide member toward the provisionally-retained position, thereby guiding said slide member into a posture inclined outwardly relative to said insertion port, and said third slanting guide surface guides said slide member in a direction of extension of said first slanting guide surface over a path of displacement of said slide member from a position where said second slanting guide surface is brought into sliding contact with said first slanting guide surface to the provisionally-retained position.

14. A connector according to claim 13, further comprising guidance structure for guiding the slide member from the cavity along a substantially continuous, arcuate path.

15. A connector according to claim 14, wherein said guidance structure includes first portions formed on the slide member and second portions formed on the housing, said second portions guiding said slide member toward a provisionally-retained position during withdrawal of the slide member.

16. A connector according to claim 15, wherein said first and second portions also include stopping portions for maintaining the slide member in the provisionally-retained position.

* * * * *